US007024972B2

(12) United States Patent
Werner et al.

(10) Patent No.: US 7,024,972 B2
(45) Date of Patent: Apr. 11, 2006

(54) TOOL FOR REMOVING AND TIGHTENING SCREW-ON DRAINS

(75) Inventors: Gary D. Werner, Lakewood, CO (US); Steven X. Johnson, Golden, CO (US)

(73) Assignee: WJ Technologies, Inc., Lakewood, CO (US)

( * ) Notice: Subject to any disclaimer, the term of this patent is extended or adjusted under 35 U.S.C. 154(b) by 99 days.

(21) Appl. No.: 10/856,566

(22) Filed: May 27, 2004

(65) Prior Publication Data

US 2004/0237275 A1 Dec. 2, 2004

Related U.S. Application Data

(60) Provisional application No. 60/569,212, filed on May 7, 2004, provisional application No. 60/473,816, filed on May 27, 2003.

(51) Int. Cl.
*B25B 23/08* (2006.01)
*B25B 23/10* (2006.01)

(52) U.S. Cl. ..... 81/443; 81/446; 81/442

(58) Field of Classification Search ..... 81/443, 81/442, 446

See application file for complete search history.

(56) References Cited

U.S. PATENT DOCUMENTS

| | | | |
|---|---|---|---|
| 1,672,053 | A | 6/1928 | Brown |
| 2,455,005 | A | 11/1948 | Hall |
| 2,715,346 | A | 8/1955 | Thomas |
| 3,296,900 | A | 1/1967 | Behnke |
| 3,847,040 | A | 11/1974 | Buffkin |
| 3,861,251 | A | 1/1975 | Streander |
| 3,874,714 | A | 4/1975 | Bebinger |
| 3,902,384 | A | 9/1975 | Ehrler |
| 4,144,779 | A | 3/1979 | Honick |
| 4,335,632 | A | 6/1982 | Irwin et al. |
| 4,338,981 | A | 7/1982 | Frauenberger |
| 4,377,965 | A | 3/1983 | Eickmann |
| 4,499,799 | A | 2/1985 | Bordages |

(Continued)

FOREIGN PATENT DOCUMENTS

EP 0571872 A1 5/1993

OTHER PUBLICATIONS

Pictures of Homemade Tool, 5 Pages.

(Continued)

*Primary Examiner*—Lee D. Wilson
*Assistant Examiner*—Alvin J. Grant
(74) *Attorney, Agent, or Firm*—Cochran Freund & Young LLC; William W. Cochran

(57) ABSTRACT

Disclosed is a tool for both removing and tightening screw-on drains that is simple and easy to use, has a simple design and is easy to manufacture. The tool is capable of engaging an inner surface of a drain flange in a manner that is sufficient to transfer enough force to remove screw-on drain flanges and is capable of use with various designs and sizes of screw-on drain flanges. Different size cams and different lever arms used on the cams allow the tool to optimize the radial force to torque ratio for both removal and insertion of screw-on drain flanges. In addition, nubs are used at the bottom of the drain flange to engage arms that typically are used on drain flanges to further add to the resistance that can be provided between the tool and the drain flange and distribute forces in a dynamic, instantaneous and automatic fashion to optimize removal of the drain flange.

24 Claims, 42 Drawing Sheets

U.S. PATENT DOCUMENTS

| | | | | |
|---|---|---|---|---|
| 4,561,330 | A | 12/1985 | Chen | |
| 5,207,131 | A | 5/1993 | Pool et al. | |
| 5,257,559 | A | 11/1993 | Cannetti | |
| 5,349,887 | A | 9/1994 | Suwa | |
| 6,035,745 | A | 3/2000 | Kather | |
| 6,212,709 | B1 | 4/2001 | Newton | |
| 6,330,840 | B1 * | 12/2001 | McCormick et al. | 81/57.3 |
| 6,338,357 | B1 * | 1/2002 | Zevgolis | 137/15.16 |
| 6,339,980 | B1 | 1/2002 | Woolf | |
| 2002/0096023 | A1 * | 7/2002 | Sanford | 81/124.2 |

OTHER PUBLICATIONS

Ridge Tool—342 Internal Wrench.
BrassCraft T150 Internal Pipe Wrench.
BrassCraft T167 Pipe Nipple Extractor.
Website: Plummingworld.com "Internal Pipe Wrench Set" 2 Pages.

* cited by examiner

TOOL FOR REMOVING AND TIGHTENING SCREW-ON DRAINS

CROSS REFERENCE TO RELATED APPLICATIONS

This application is based upon and claims the benefit of U.S. Provisional Patent Application 60/473,816 entitled "Tool for Removing and Tightening Screw-On Drains" filed May 27, 2003, and U.S. Provisional Patent Application 60/569,212 entitled "Tool for Removing and Tightening Screw-On Drains" filed May 7, 2004. The entire contents of both are hereby incorporated by reference for all that they disclose and teach.

BACKGROUND OF THE INVENTION a. Field of the Invention

The present invention pertains generally to plumbing and more particularly to a tool for removing and tightening screw-on drains.

b. Description of the Background

Screw-on drains are typically used in bathtubs and other applications such as utility sinks and other types of sinks or liquid retainers. The drain normally consists of a screw-on flange, commonly referred to as a bathtub shoe, that is threaded with male threads, and that is inserted through the top of the enclosure, such as a bathtub enclosure or sink enclosure, and that mates with a screw-on drain receptacle underneath and outside of the enclosure. Typically, silicone is placed between the flange portion and the inside of the enclosure to provide a good seal between the inside of the enclosure and the flange. This silicone hardens like a glue to hold the flange in place and prevent leakage. Other types of sealants have also been used. In addition, Teflon tape, or plumber's putty, may be used on the threaded portion of the flange to prevent leakage.

After the drain assembly has been in place for a period of time, it can be very difficult to remove the screw-on flange for repair or replacement. In many instances, the flange portion must be cut out with a hacksaw. In addition, during assembly it would be advantageous to tighten the flange portion into the receptacle portion with sufficient force to insure that leakage does not occur.

Tools for removing and inserting screw-on flanges have previously been used. One type of tool has prongs that engage the spokes or arms that are normally disposed on drain flanges. Because of the large force required to remove these drain flanges, the spokes or arms do not normally provide enough structural rigidity to remove the drain flange.

Other tools have been used to remove drain flanges. Typically, these tools are quite complex and difficult to use. These tools typically engage the arms (which are commonly known as "webs") of the drain flange which fail during attempts to remove the drain flange.

In addition, there are approximately seventeen different types of screw-on drains that currently exist that are made in different designs and different sizes. Currently existing tools are unable to be used with all of the different designs and sizes of the various screw-on drains.

A need therefore exists for a tool that is simple and easy to use, is capable of providing adequate engagement of a screw-on drain flange so that adequate force can be applied to the drain flange to remove it and is capable of use with the various designs and sizes of screw-on drain flanges.

SUMMARY OF THE INVENTION

The present invention overcomes the disadvantages and limitations of the prior art by providing a tool for removing and tightening screw-on drain flanges that is simple and easy to use, has a simple design that is easy to manufacture, that is capable of engaging the inner surface of the drain flange in a manner that is sufficient to transfer enough force to remove the screw-on drain flange, and that is capable of use with the various designs and sizes of screw-on drain flanges.

The present invention may therefore comprise a tool for inserting and removing a drain flange comprising a driver having a round portion that is adapted to receive torque; a main body having an upper main body flange and a lower main body flange that are coupled via a main body support to form a slot between the upper main body flange and the lower main body flange, the upper main body flange having an opening in which the round portion of said driver fits and rotates, the main body having a frictional surface disposed along predetermined portions of an outer surface of the main body; a cam having a thickness that allows the cam to be inserted and rotated in the slot, the cam attached to the driver in a position that is offset from a center point of the cam so that the round portion of the driver rotates in the round opening of the upper main body flange and rotates the cam between a closed position and an extended position relative to the main body, the cam having a frictional surface to engage the drain flange in the extended position.

The present invention may further comprise a method of providing a tool for inserting and extracting a drain flange comprising providing a driver having a round portion that is adapted to receive torque applied to the driver; providing a main body having an upper main body flange and a lower main body flange that are coupled via a main body support to form a slot between the upper main body flange and the lower main body flange, the upper main body flange having a round opening in which the round portion of the driver fits and rotates, the main body having a frictional surface disposed along predetermined portions of an outer surface of the main body; providing a cam having a thickness that allows the cam to be inserted and rotated in the slot, the cam attached to the driver in a position that is offset from a center point of the cam so that the round portion of the driver rotates in the round opening of the upper main body flange and rotates the cam between a closed position and an extended position relative to the main body, the cam having a frictional surface that engages the drain flange in the extended position; providing a nub attached to the lower main body flange that is adapted to engage an arm of the drain flange and exert a clockwise force on the arm whenever the driver creates a clockwise torque so that the cam is forced against the main body support and the main body rotates in a clockwise direction in the drain flange around the nub until a smooth section of the main body portion rests against an inner surface of the drain flange, and exert a force on the arm in a counterclockwise direction whenever the driver creates a counterclockwise torque so that the main body rotates in a counterclockwise direction in the drain flange around the nub until the frictional surface on the main body engages an inner surface of the drain flange and the cam is rotated to the extended position so that the frictional surface on the cam engages the inner surface of the drain flange.

Advantages of the present invention include the ability of the tool to be used with any of the various different size and type of drain flanges while using only two different cams or a modified cam. The design is very elegant because it is simple and inexpensive to manufacture while providing the strength and durability to remove and tighten the various types and sizes of screw-on drain flanges. The design allows easy and quick replacement of a cam so that the tool can be used with various sizes and designs of drain assembly flanges. The embodiments disclosed can be used for removal of bathtub assembly flanges which requires a high degree of strength and durability, as well as the tightening of the bathtub assemblies which requires that the surface of the flange not be marred. The design also allows the cam to be easily replaced with at least one other size cam to fit various size drain flange assemblies in a simple and easy manner. At least one embodiment utilizes a releasable driver that is releaseably engaged in the main body of the tool. Embodiments are disclosed that include a socket receptacle on the driver so that socket ratchets or breaker bars can be used, as well as extensions and other common tool pieces. In addition, power tools such as power drills, can be used with the present invention.

DETAILED DESCRIPTION OF THE INVENTION

Figure 1:
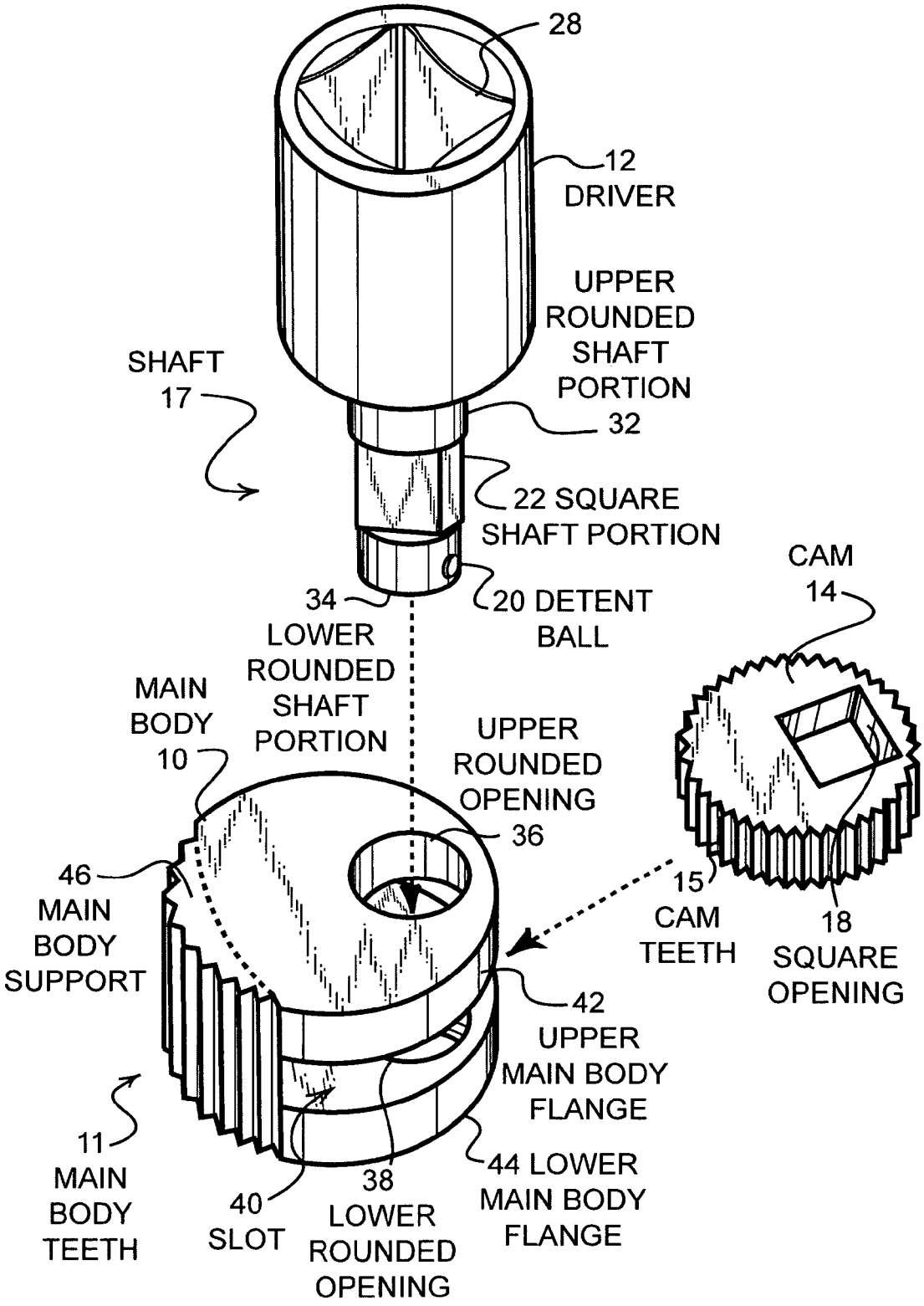
FIG. 1 is an isometric assembly drawing of one embodiment of the invention.

FIG. 1 is an isometric assembly view of three pieces of one embodiment of the present invention. The three primary pieces of this embodiment comprise the main body portion 10, the driver 12 and the cam 14. The main body portion 10 has teeth 11 formed therein along the outer sidewall portions adjacent the main body support 46. The main body portion has an upper main body flange 42 and a lower main body flange 44 that are connected by the main body support 46. As such, a slot 40 is formed between the upper main body flange 42 and the lower main body flange 44. The upper main body flange 42 has an upper rounded opening 36 formed therein which is in alignment with a lower rounded opening 38. The upper rounded opening 36 has a diameter that is larger than the lower rounded opening 38.

The driver 12 includes a socket portion 28 and a shaft 17. The shaft 17 has an upper rounded shaft portion 32, a square shaft portion 22, and a lower rounded shaft portion 34. The upper rounded shaft portion 32 has a diameter corresponding to the upper rounded opening 36 in the main body 10 with some tolerance for insertion and movement of the shaft 17. Similarly, the lower rounded shaft portion 34 has a diameter corresponding to the lower rounded opening 38 with some tolerance for insertion of the lower rounded shaft portion 34 into the lower rounded opening 38 to allow movement of the shaft 17. The detent ball 20 is a standard spring-loaded detent ball that engages a groove illustrated in FIG. 3 located in the lower rounded opening 38. Although the driver 12 is shown as having a particular design, any type of driver mechanism can be used as long as it can rotate in the main body 10 and hold the cam 14 in slot 40 so that it can rotate between an open and closed position. For example, it is not necessary that the driver 12 have a square socket opening that is adapted to receive a socket wrench. The driver 12, for example, could be adapted to receive any type of wrench or handle for rotating the driver 12. In addition, the driver may be adapted to receive a power tool, such as a power drill. The driver 12, as shown in FIG. 1, has a lower rounded shaft portion 34 and an upper rounded shaft portion 32 that rotate in the lower main body flange 44 and the upper main body flange 42, respectively. These two areas of rotation provide stability for the tool and prevent binding. However, as disclosed below in another embodiment, an upper rounded opening, such as opening 36, may be used as a single point of rotation. Further, the cam 14 may be attached to the driver 12 in any desired manner including gluing, braising, welding, casting, detent balls that engage grooves and an opening in the cam 14 such as square opening 18, or other methods known those skilled in the art.

As also shown in FIG. 1, the cam 14 has a series of cam teeth 15 located around the outer surface of the cam 14. The cam 14 also has a square opening 18 that is located off-center in the cam 14. The square opening 18 has a dimension that corresponds to the square shaft portion 22 to allow the square shaft portion 22 to be inserted in the square opening 18 with some tolerance. Although the cam 14 is shown as a rounded disk, in other embodiments disclosed herein the cam can have a non-linear shape such as an elliptical shape or parabolic shape. In addition, portions of the cam 14 can be removed to allow rotation in the slot 40. Removal of portions of the cam allow for a greater radial extension of the cam during operation, as explained in more detail below. However, removal of portions of the cam may compromise the strength of the cam.

In operation, the tool is assembled by placing the cam 14 in the slot 40 such that the square opening is centrally aligned with the upper rounded opening 36 and the lower rounded opening 38. The driver 12 is then inserted through the upper rounded opening in the upper main body flange 42, through the square opening 18 in the cam 14 and through the lower rounded opening 38 in the lower main body flange 44. The driver 12 can then be rotated with a socket wrench, such as a breaker bar or ratchet, so that the cam 14 rotates in the slot 40. The slot 40 has a sufficient depth to allow the cam 14 to substantially retract within the slot 40. Upon rotation, the cam 14, because of the offset center of the square opening 18, rotates to a radial extended dimension as described below.

Figure 2:
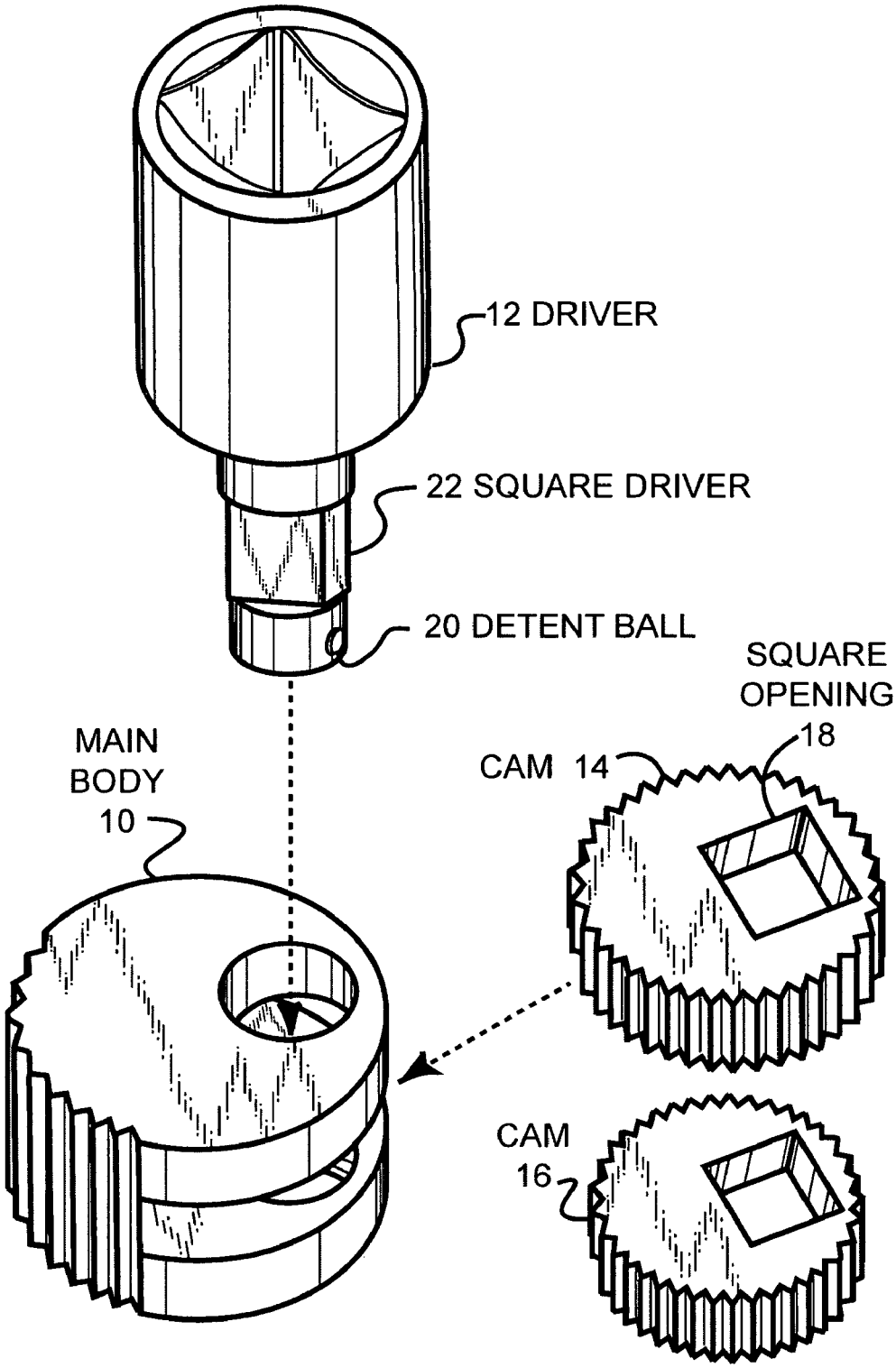
FIG. 2 is an assembly drawing of the embodiment of FIG. 1 showing the use of two different cam sizes.

FIG. 2 is an isometric view of the present invention that illustrates the use of two different cams with the driver 12 and main body 10. As shown in FIG. 2, a larger size cam 14 can be assembled with the main body 10 and the driver 12 as described above. This larger cam can be used to engage drain flanges, pipes or other devices for either extraction or insertion by rotating the device. Cam 16 is a smaller cam that allows the tool illustrated in FIG. 2 to engage drain flanges, pipes or other devices having a smaller internal diameter. Cam 16 is assembled with the main body 10 and driver 12 in the manner described above with regard to FIG. 1.

Figure 3:
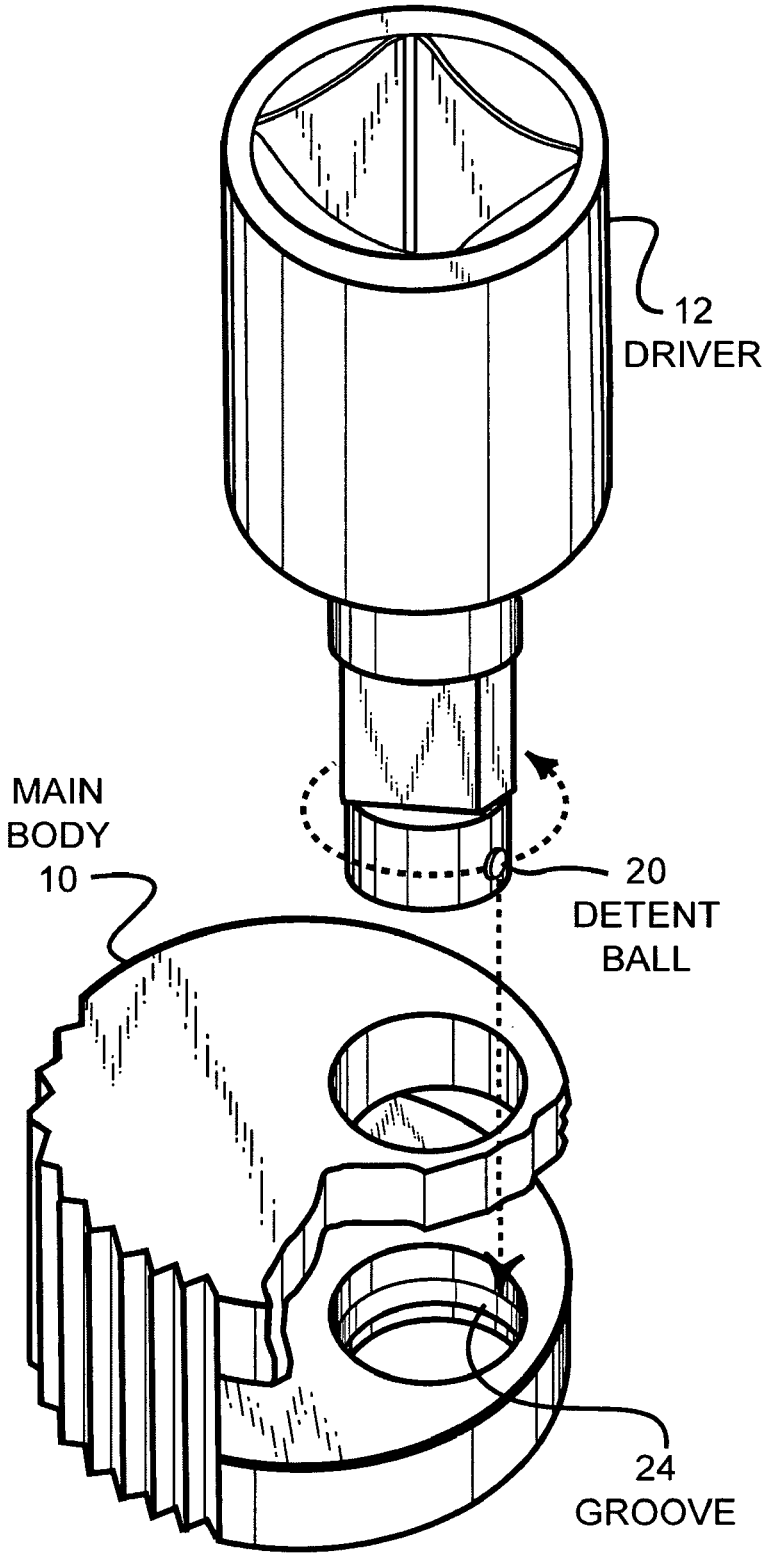
FIG. 3 is an isometric assembly view illustrating the manner in which the driver engages the main body.

FIG. 3 is another isometric view of the disassembled tool with a portion of the main body 10 shown as a cut away drawing. FIG. 3 illustrates that the detent ball 20 is aligned to engage the groove 24 in the lower main body flange 44. The detent ball 20, when engaged in the groove 24 maintains the driver 12 in the main body 10 so that the tool can be operated without coming apart.

Figure 4:
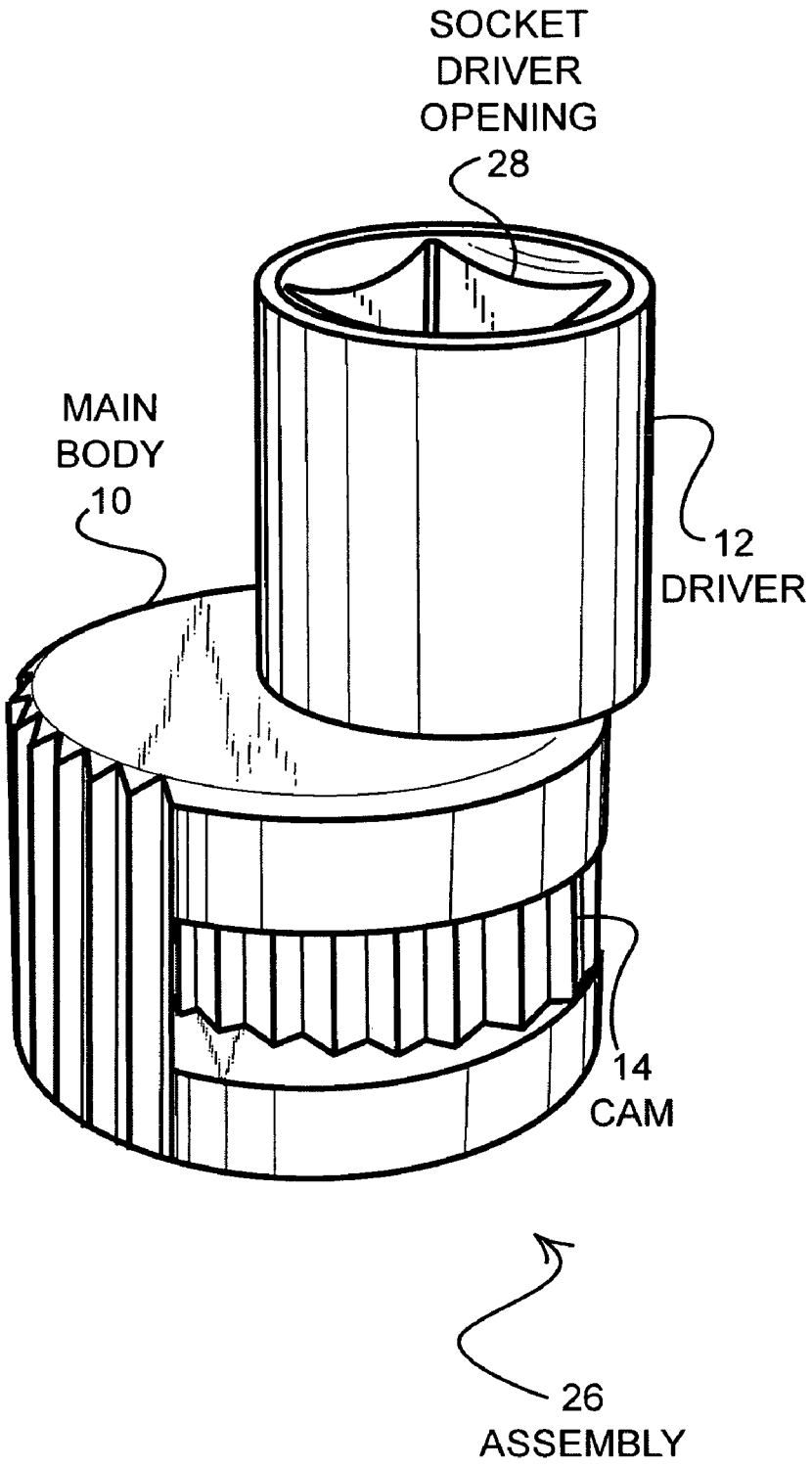
FIG. 4 is an isometric view of the assembled tool with the cam in a closed position in the main body.

FIG. 4 is an isometric view of the assembled tool 26. The assembly 26 includes the main body 10, the driver 12 and the cam 14. Driver 12 has a socket opening 28 to allow a socket driver to drive the driver 12. In FIG. 4, the cam 14 is rotated to an interior position in the slot 40 so that the tool can be inserted into a drain flange for either assembly or removal of the drain flange. Of course, the present invention can be used with pipes or other threaded objects for both insertion and removal.

Figure 5:
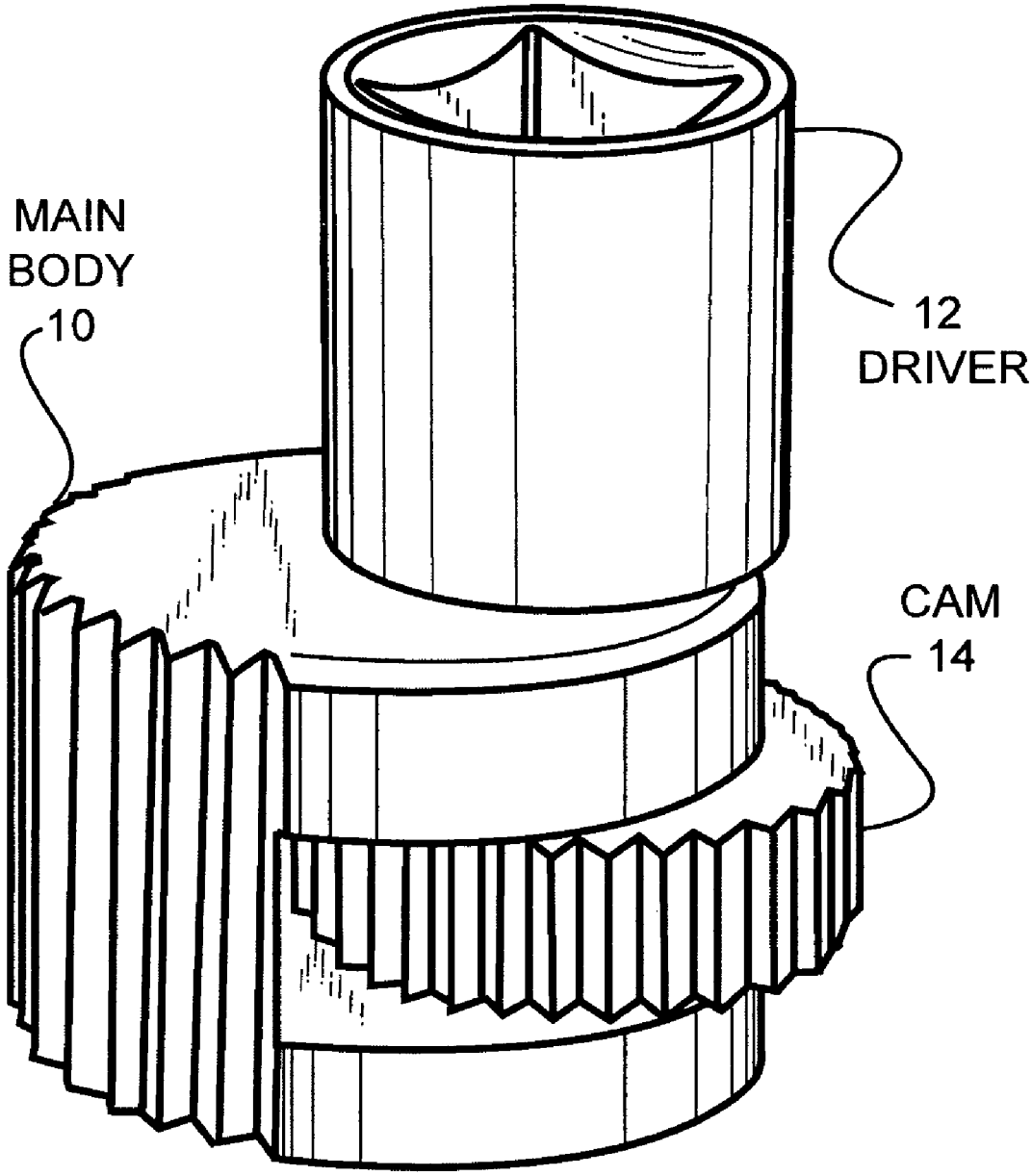
FIG. 5 is an isometric view of the assembled tool with the cam in an extended position.

FIG. 5 is another isometric view of the assembled tool of the present invention including the main body 10, the driver 12 and the cam 14. In FIG. 5, the cam is rotated to an outward position so that the cam provides a radial extended dimension for engaging the internal surface of a drain flange, pipe or other device. As indicated in FIG. 5, the cam 14 has been rotated in a counter-clockwise direction viewed from the top which indicates that the tool would be used in this orientation for removing drain flanges, pipes or other devices. Of course, the cam 14 can be fully rotated to the full counter-clockwise position and inserted in a drain flange, pipe or other device and then rotate it in the clockwise direction to engage the drain flange, pipe or other device for assembly purposes.

Figure 6:
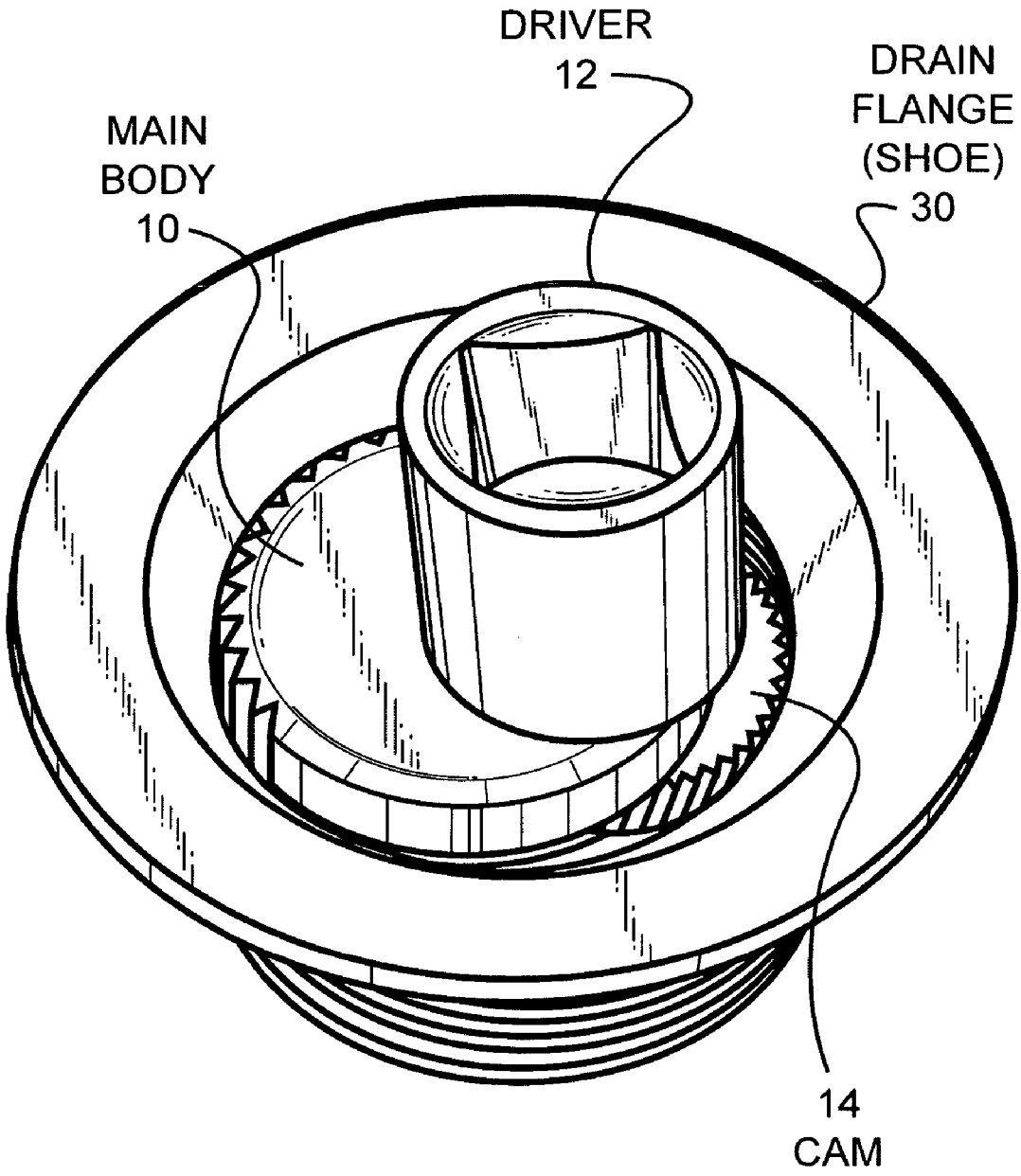
FIG. 6 is an isometric view of the embodiment of FIG. 1 engaged in a bathtub drain flange.

FIG. 6 is an isometric view of the tool that is inserted in a drain flange 30 that is otherwise known as a shoe or drain shoe. As shown in FIG. 6, the cam 14 is rotated in a counter-clockwise direction to engage the inner surface of the drain flange 30. This forces the teeth of the main body portion 10 to engage an opposing surface of the inner surface of the drain flange 30.

Figure 7:
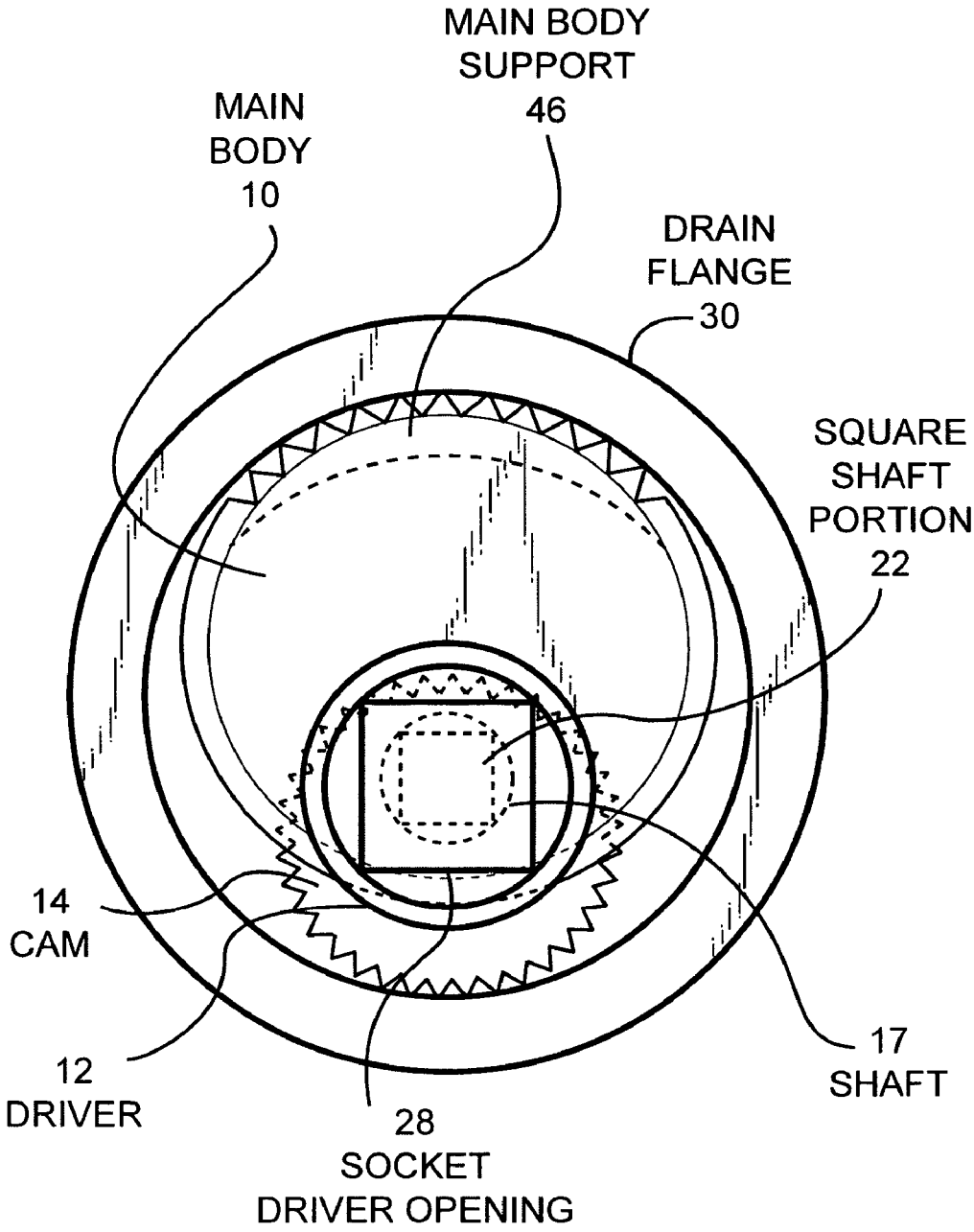
FIG. 7 is a top view of the embodiment of FIG. 1 engaged in a bathtub drain flange.

FIG. 7 is a top view of the tool disposed in a drain flange. As shown in FIG. 7, the main body 10 has teeth 11 which engage the inner surface of the drain flange 30. The cam 14 is rotated so that the teeth on the cam engage an opposing surface of the drain flange 30. This occurs when the driver 12 is rotated with a socket drive that is inserted in the socket drive opening 28. FIG. 7 also illustrates the shaft 17 and the square shaft portion 22 that engages the cam 14 to allow rotation of the cam from an off-center position so that the cam extends in a radial direction away from the main body 10 to engage the inner surface of the drain flange 30.

FIG. 7 also illustrates the main body support 46 that connects the flanges of the main body 10. As also shown in FIG. 7, the cam is rotated to nearly a fully extended position. Engagement of the drain flange 30 with the cam 14 in the nearly fully extended position results in the radial forces generated by the cam and the main body portion to be maximized. By increasing the radial forces, the teeth on the main body portion 10 and cam 14 engage the drain flange 40 with greater pressure to prevent slippage between the tool and the drain flange 30. However, if the radial forces are increased substantially in comparison to the circumferential forces generated by torque applied to driver 12, the flange can be oblonged (ovaled) in the process of either inserting or removing the drain flange 30. Hence, the ratio of radial force to circumferential torque can be adjusted by using different size cams 14 to adjust the amount of extension of the cam 14 at the point of engagement of the cam 14 with the flange. The closer the cam 14 is to its full extension point when the cam 14 engages the drain flange 30, the greater the radial force applied by the cam 14 and the main body portion 10 to the drain flange 30. Conversely, the farther the cam 14 is away from its maximum extension point when the cam 14 engages the drain flange 30, the lower the radial force. Since the torque applied by the driver to the cam causes the cam to extend, the position of the cam when it engages the drain flange 30 generates a ratio of radial force to torque that is constant. Again, this ratio of the amount of radial force compared to the torque applied to the tool, which affects whether the tool will adequately engage the drain flange without slippage, can cause oblonging or ovaling of the drain flange, and/or marring of the internal surface of the drain flange, during insertion of the drain flange, and other potentially deleterious effects. Hence, selection of the size of the disk for a particular size drain flange, which determines the amount of extension of the cam at the point of engagement with the drain flange, determines the ratio of radial force to torque so that the user can select the proper disk to achieve the proper radial force to torque ratio.

Figure 8:
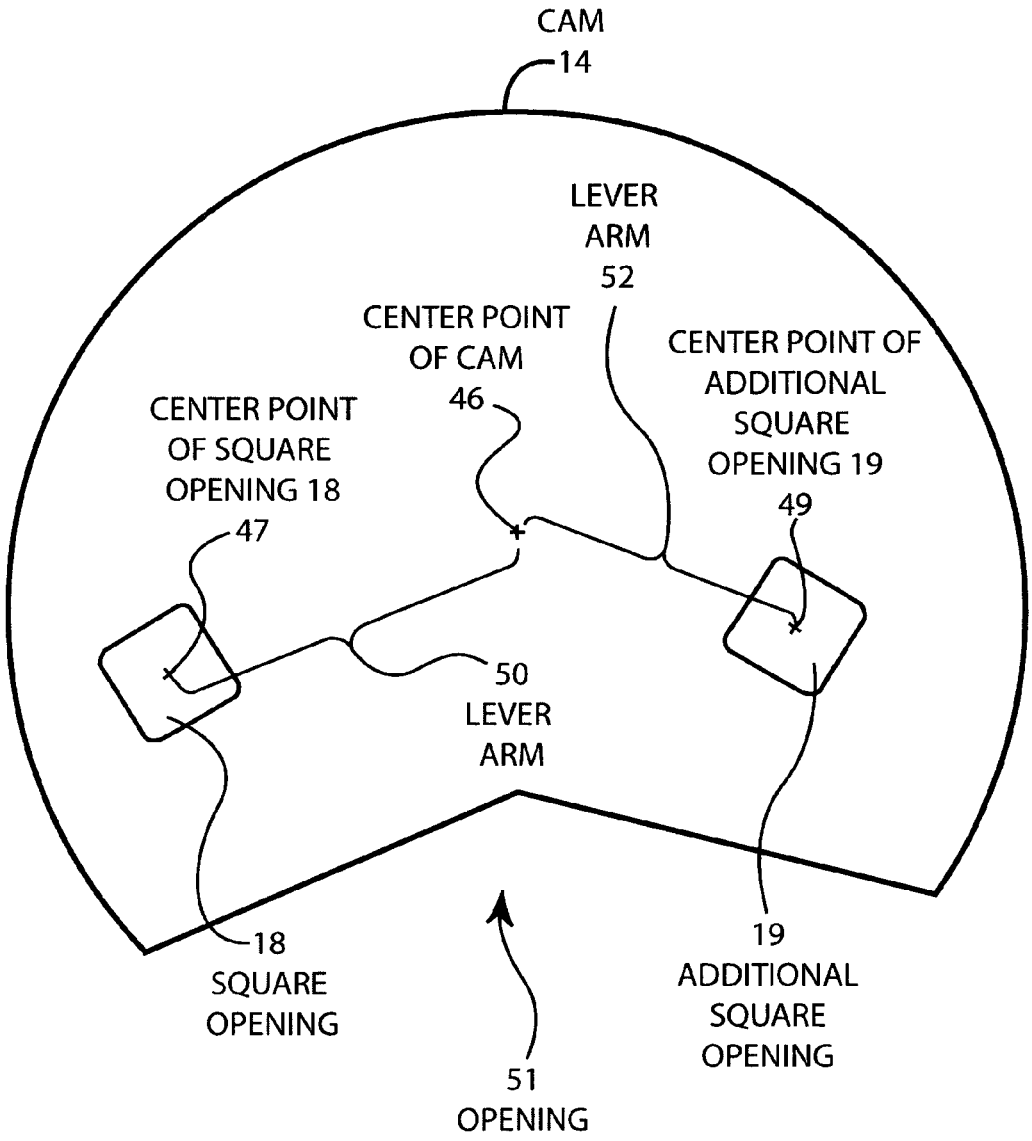
FIG. 8 is a schematic view of one embodiment of a cam.

FIG. 8 illustrates another implementation of the invention which allows the user to vary the lever arm and hence, the center of rotation of the cam 14 to achieve a result similar to changing the size of the disk, as described above. As shown in FIG. 8, square opening 18 has a lever arm 50 that is a predetermined distance from the center of the square opening 47 to the center point 46 of the cam 14. Since the cam 14 rotates around the center point 47 of the square opening 18, the amount of extension of the cam 14 is determined by the distance 50 from the center point 46 of the cam 14. Hence, the extension of the cam 14 from the main body 10 is determined by the distance 50. The distance 50 is also the lever arm which determines the amount of torque as a percentage of the amount of radial force that is applied by the cam 14.

FIG. 8 also shows an additional square opening 19 located in the cam 14. The additional square opening 19 has a center point 49 that is a predetermined distance from the center point 46 of the cam 14. This distance is the lever arm 52. Since lever arm 52 is shorter than lever arm 50, the cam 14 does not extend as far out of the main body 10 when rotated around the center point 49 of additional square opening 19. In addition, since the lever arm 52 is shorter, higher mechanical leverage is achieved. In other words, less force will have to be applied to the driver using additional square opening 19 to achieve the equivalent torque when using square opening 18. However, the shorter lever arm 52 causes the cam 14 to not extend as far out of the main body 10 so that the shorter lever arm 52 has the same effect as using a smaller cam. Of course, since the additional square opening 19 is on the opposite side of the cam 14 as square opening 18, cam 14 may have to be removed and turned over to either tighten or loosen the drain flange 30, as desired, if the tool is not designed to allow clearance of the cam 14 around the main body support 46. However, having two openings in the cam 14 eliminates the need for having separate cams 14 of different sizes. In addition, the V-shaped opening 51 may have to be modified to allow sufficient clearance using the two square openings as shown in FIG. 8.

Figure 9:
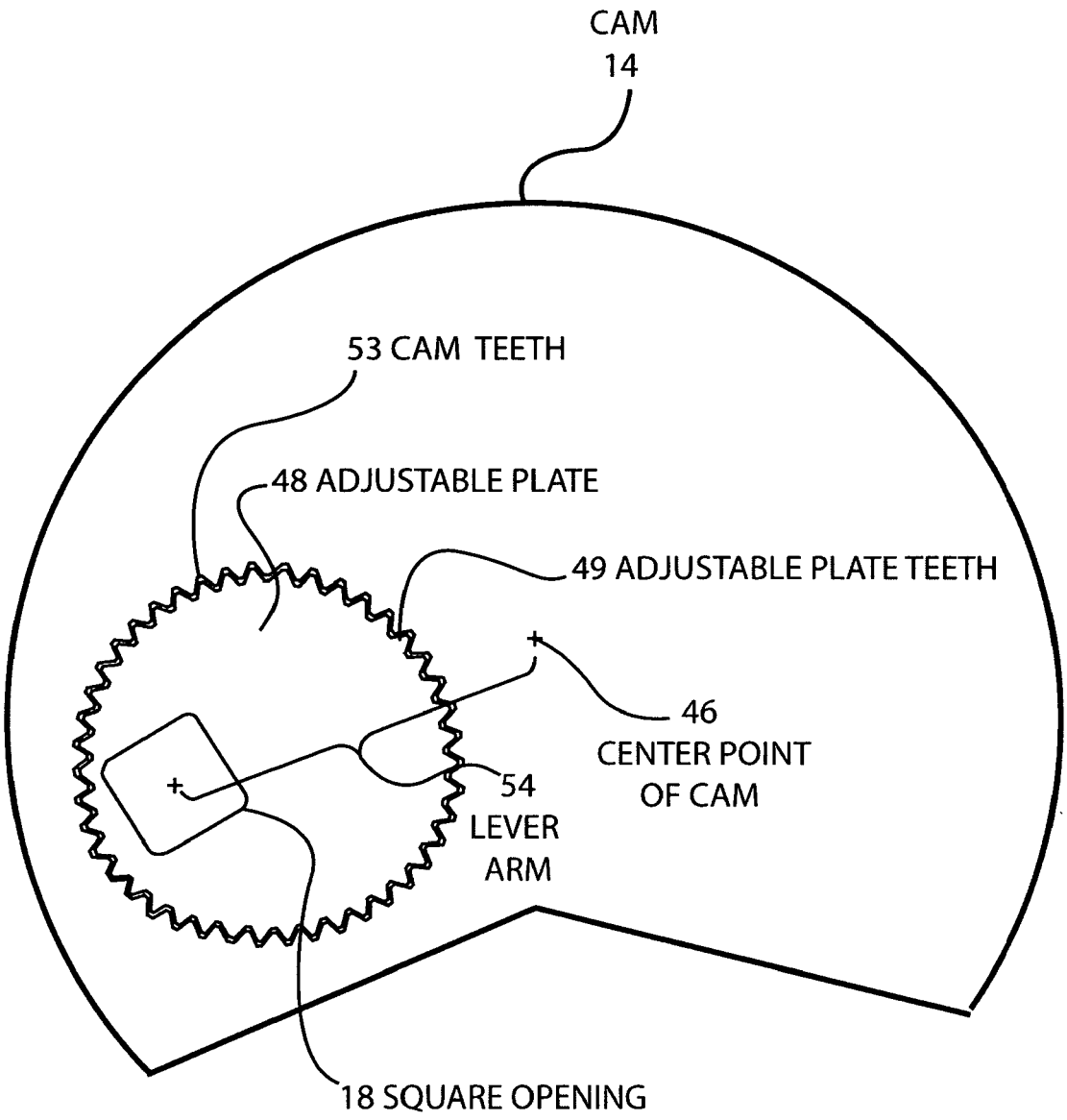
FIG. 9 is a schematic illustration of another embodiment of a cam.

FIG. 9 illustrates another embodiment of the cam 14 that allows the user to vary the lever arm distance of the square opening 18 in the cam 14. As shown in FIG. 9, an adjustable plate 48 is a removable plate that sits within the cam 14. The adjustable plate 48 has teeth 49 that engage teeth 53 of the cam 14. The adjustable plate 48 is round in shape and can be removed from the cam 14 and rotated to a different radial location on the cam 14. In this fashion, the lever arm 54 can be adjusted by moving the distance of the center point of the square opening 18 relative to the center point 46 of the cam 14. An advantage of the implementation of FIG. 9 is that the lever arm 54 can be adjusted with a high degree of precision and thereby adjusting the engagement point of the cam 14 with the drain flange 30.

Again, any type of driver 12 can be used with the cams illustrated in FIGS. 7, 8 and 9. It is not necessary that the driver 12 be attached to the cam 14 using a square opening, but may be attached in any of the ways described herein. It should also be pointed out that in all of the embodiments disclosed herein, the upper main body flange and the lower main body flange are attached using a main body support which can be assembled after the driver 12 is attached to the cam 14. The upper and lower main body flanges may be attached through the main body support in any desired manner including welding, braising, bolting, screwing, sliding, etc.

Figure 10:
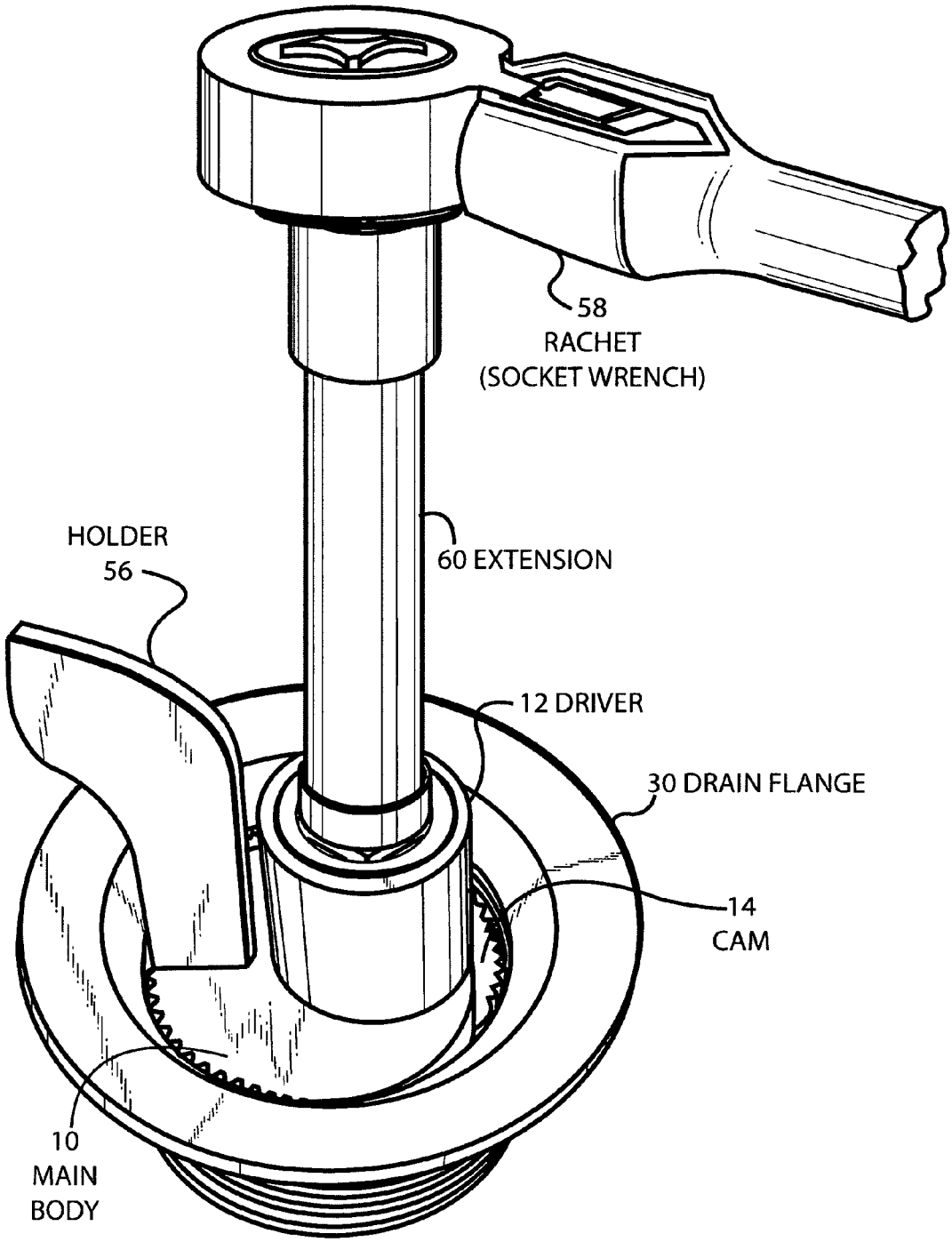
FIG. 10 is an illustration of another embodiment of the invention inserted in a drain flange.

FIG. 10 is a perspective view of another embodiment of the present invention. As shown in FIG. 10, the main body portion 10 has a holder 56 attached at the upper surface of the main body portion that extends out of the drain flange 30 so that a user can insert the main body portion 10 into the drain flange 30 and hold the main body portion stationary during application of torque. Torque is applied through ratchet 58, extension 60, to the driver 12, which rotates the cam 14 inside the drain flange 30.

Figure 11:
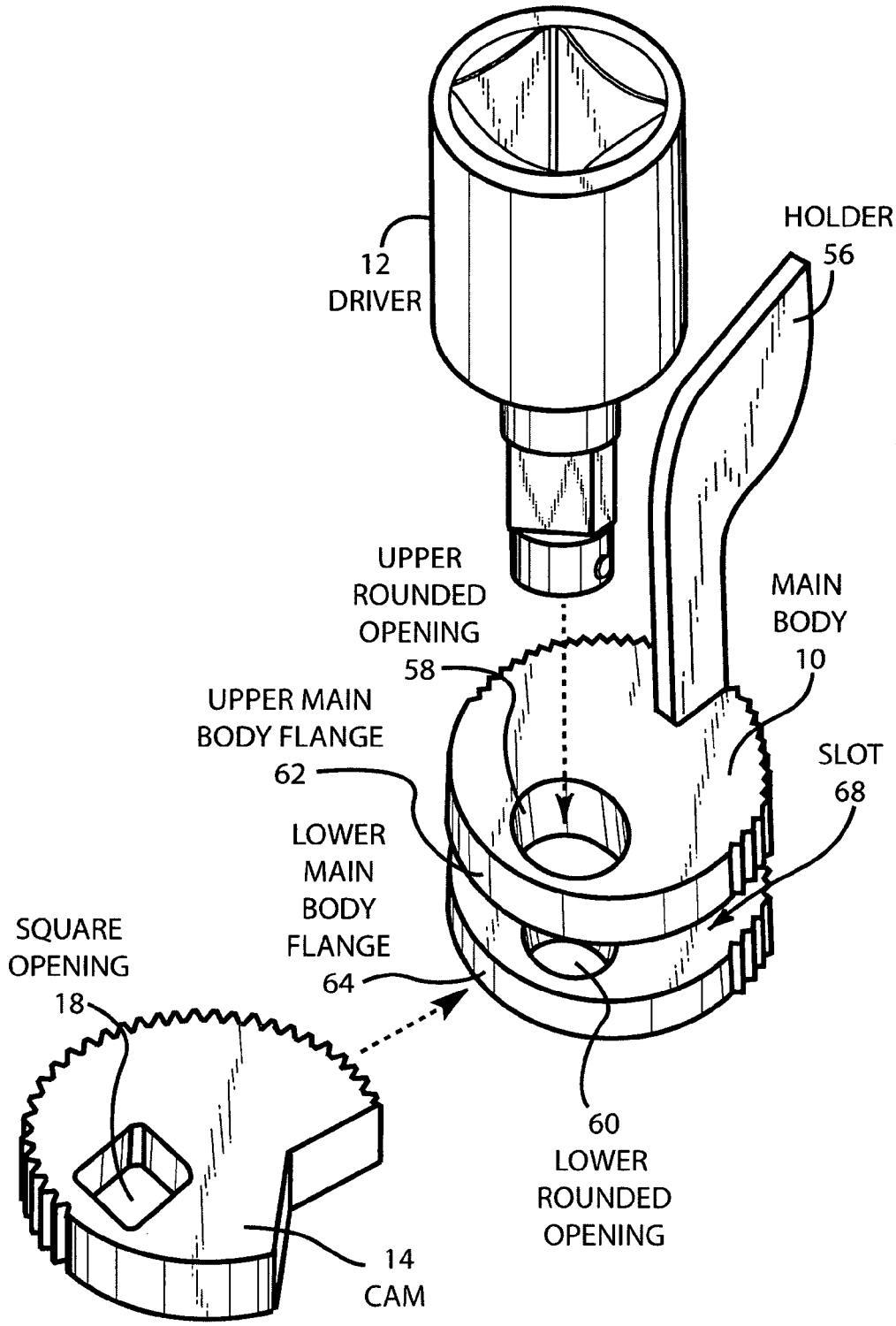
FIG. 11 is an isometric assembly view of the embodiment of FIG. 10.

FIG. 11 is an assembly view of the embodiment of FIG. 10. As shown in FIG. 11, the main body portion 10 has an upper main body flange 62 and a lower main body flange 64 that form a slot 68. A holder 56 is attached to the upper surface of the upper main body flange 62. The upper main body flange 62 has an upper-rounded opening 58, while the lower main body flange 64 has a lower rounded opening 60. The driver 12 is inserted through the upper rounded opening 58 and through square opening 18 in the cam 14. Rotation of the driver 12 causes the cam 14 to extend out of the slot 68 in the main body 10.

Figure 12:
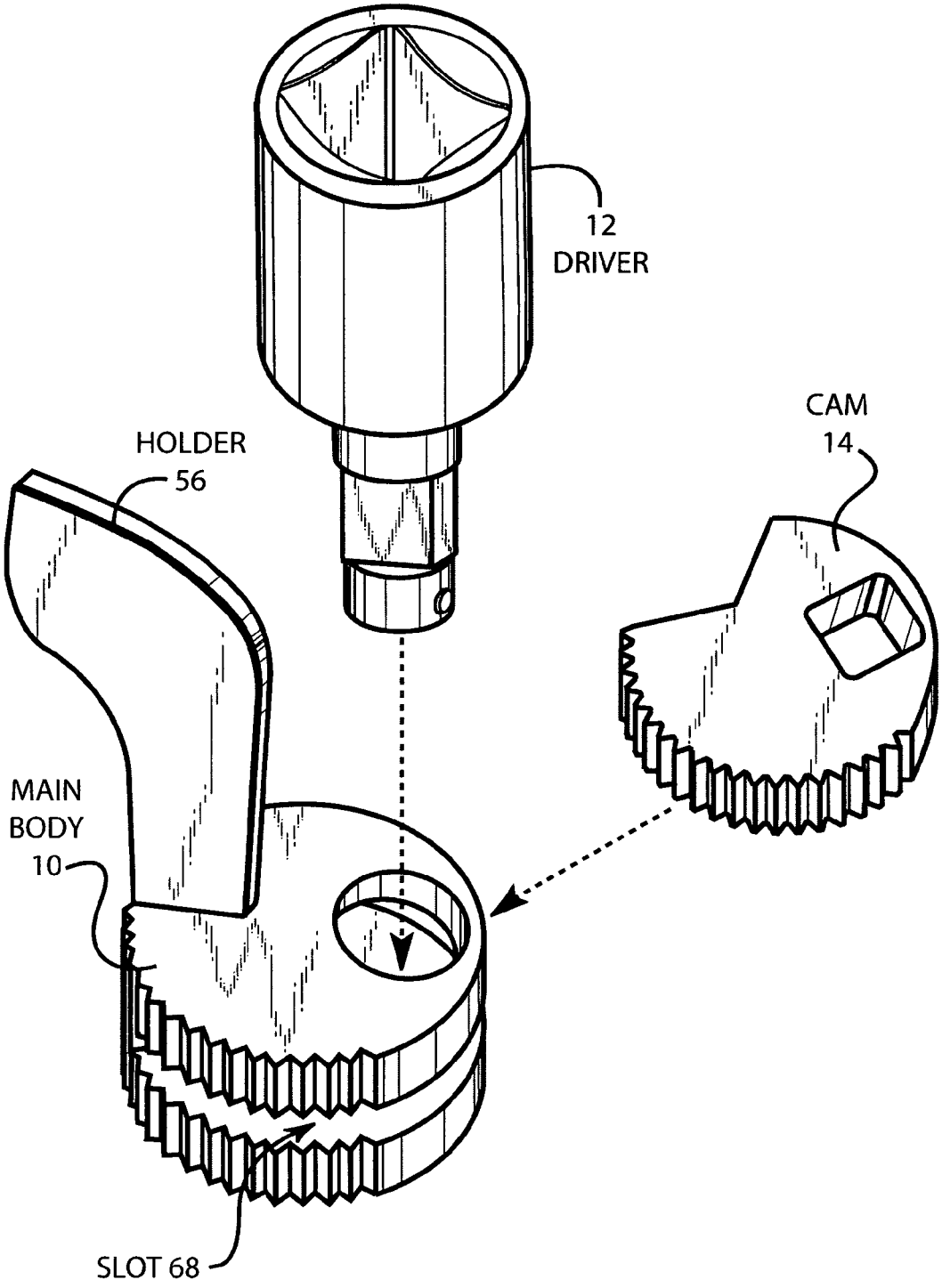
FIG. 12 is another assembly view of the embodiment of FIG. 10.

FIG. 12 is an additional view of the embodiment of FIG. 11. As shown in FIG. 12, the main body 10 has a slot 68 in which the cam 14 is inserted. The driver 12 is inserted through the hole and through the square opening in the cam to engage the cam. Holder 56 is mounted on the top of the main body portion 10.

Figure 13:
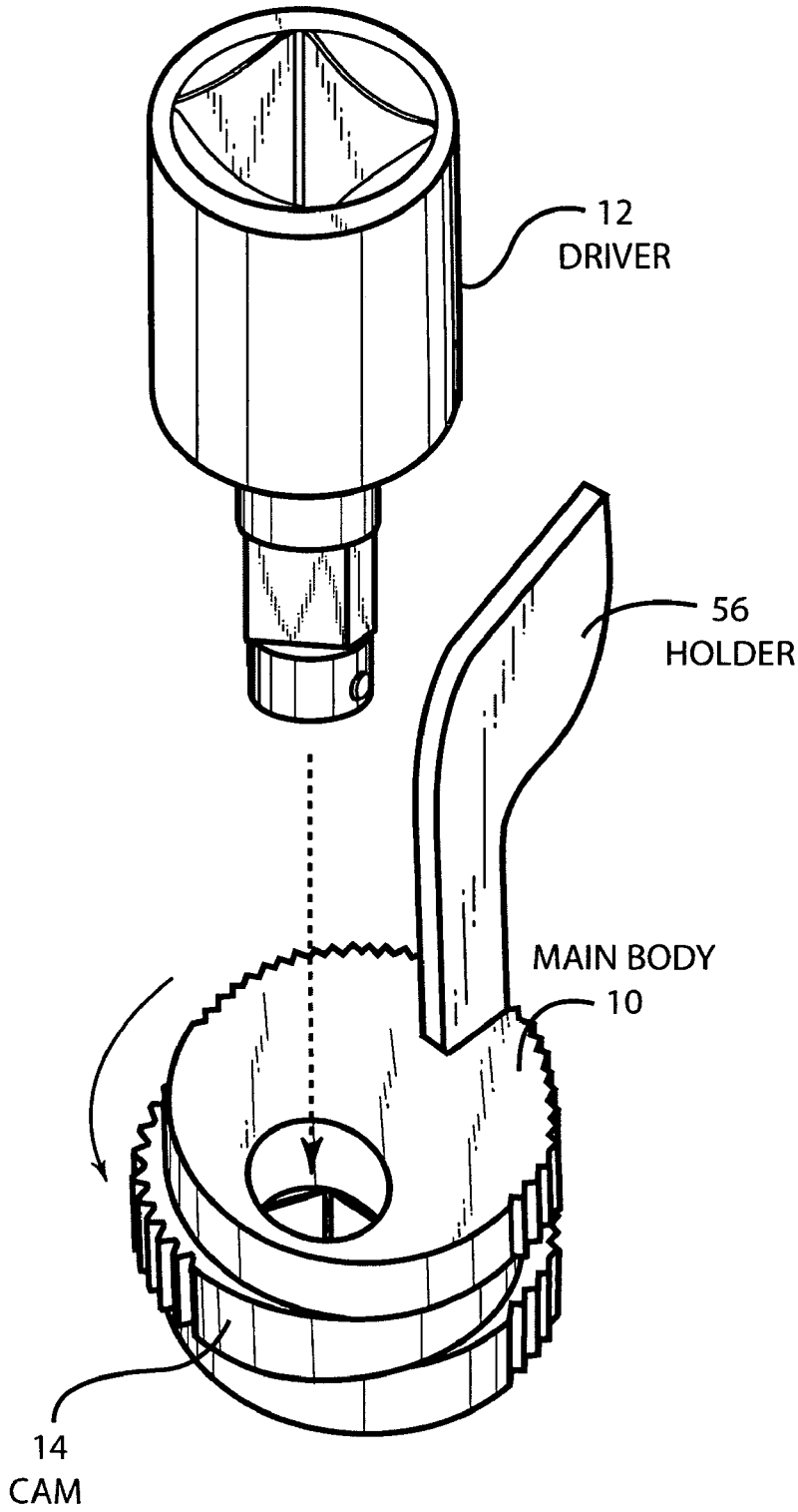
FIG. 13 is another assembly view of the embodiment of FIG. 10.

FIG. 13 is an additional view of the embodiment illustrated in FIG. 12. As shown in FIG. 13, the driver is inserted through the hole in the main body portion 10. Holder 56 is attached to the main body portion in the same manner as described above. FIG. 13 illustrates the cam 14 inserted in the slot of the tool in a closed position which allows insertion of the tool into the drain flange 30 using holder 56. As shown in FIG. 13, the cam 14 is inserted in this slot so that it can be rotated in a counterclockwise position, viewed from the top, which will rotate the drain flange in a counterclockwise rotation to remove the drain flange from a threaded holder.

Figure 14:
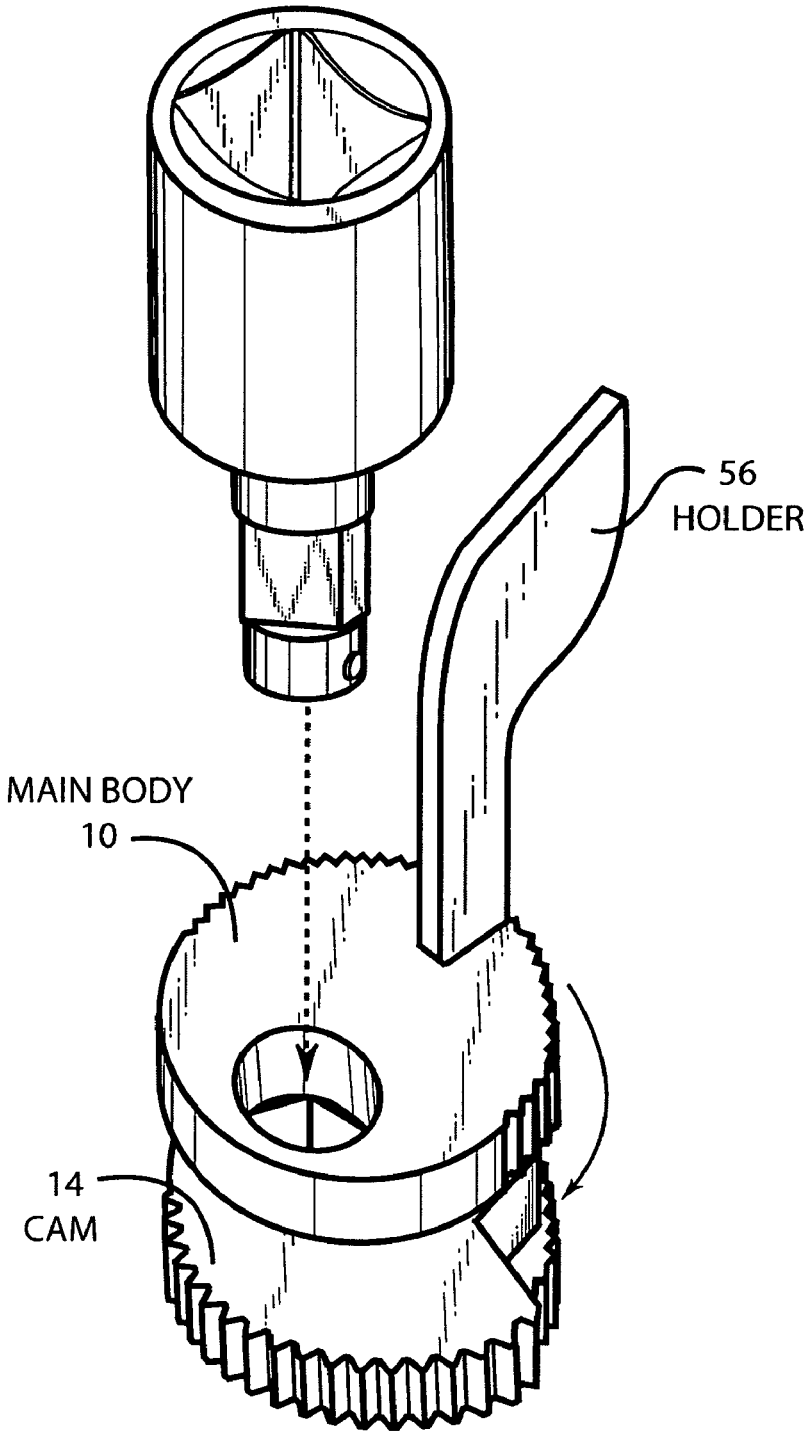
FIG. 14 is another assembly view of the embodiment of FIG. 10.

FIG. 14 is another illustration of the embodiment illustrated in FIG. 13 showing the cam 14 in a partially extended position. As illustrated in FIG. 14, the cam 14 is inserted in the slot in the main body 10. The driver 12 is inserted through the main body portion 10 and the cam 14. The cam 14 is rotated in a clockwise direction to assist in the process of inserting the drain flange in a threaded receiver. Holder 56 is used to maintain the tool in a stationary position relative to the drain flange 30 during rotation of the cam 14.

Figure 15:
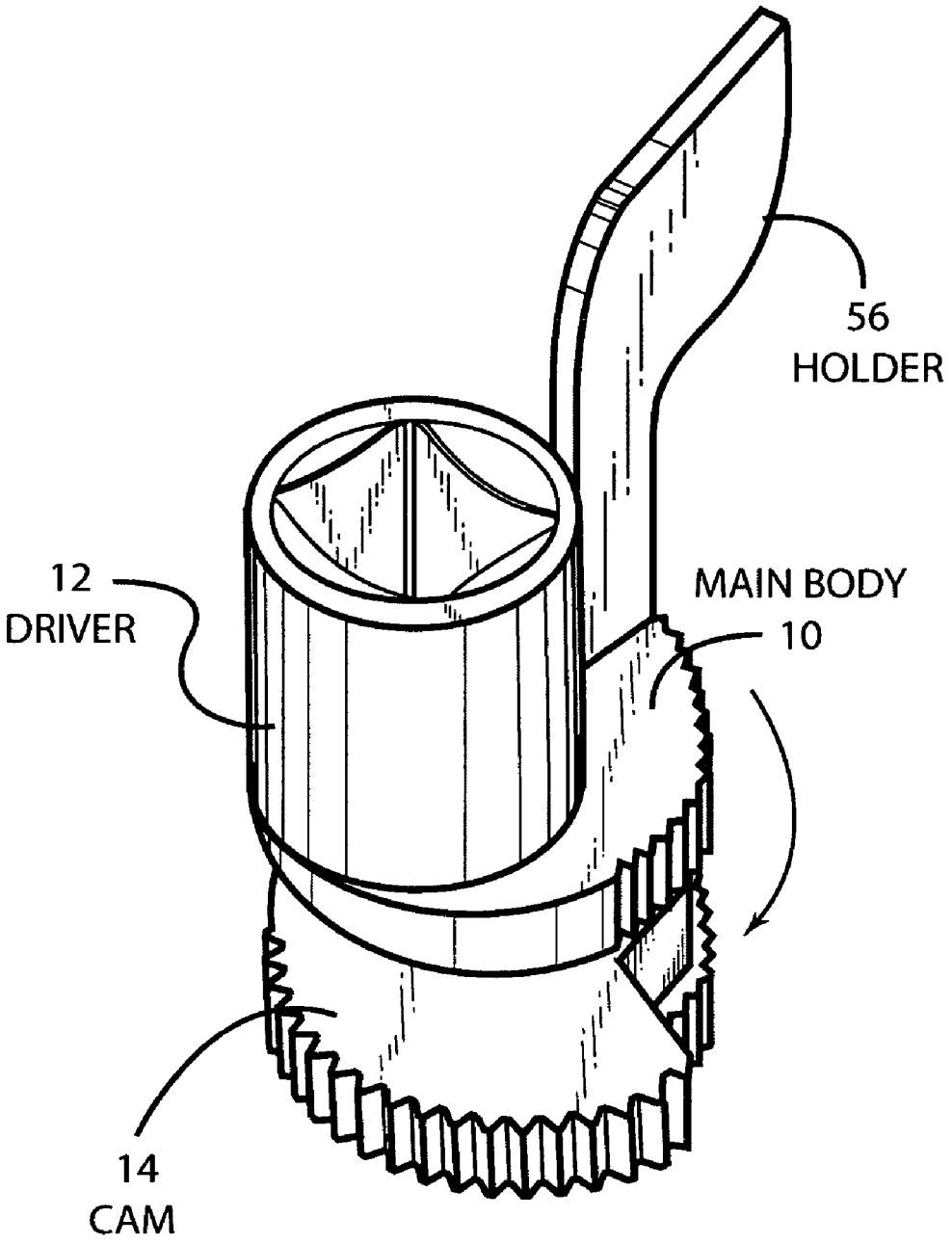
FIG. 15 is an isometric view of the assembled tool of the embodiment of FIG. 10 with the cam in an extended position.

FIG. 15 is an additional illustration of the embodiment of FIG. 14. As shown in FIG. 15, the driver 12 is inserted through the openings in the main body 10 and through the cam 14. The cam 14 is rotated in a clockwise direction, viewed from the top, to a nearly extended position. Holder 56 is used to maintain the tool in a stationary position relative to the drain flange 30 during rotation of the cam.

Figure 16:
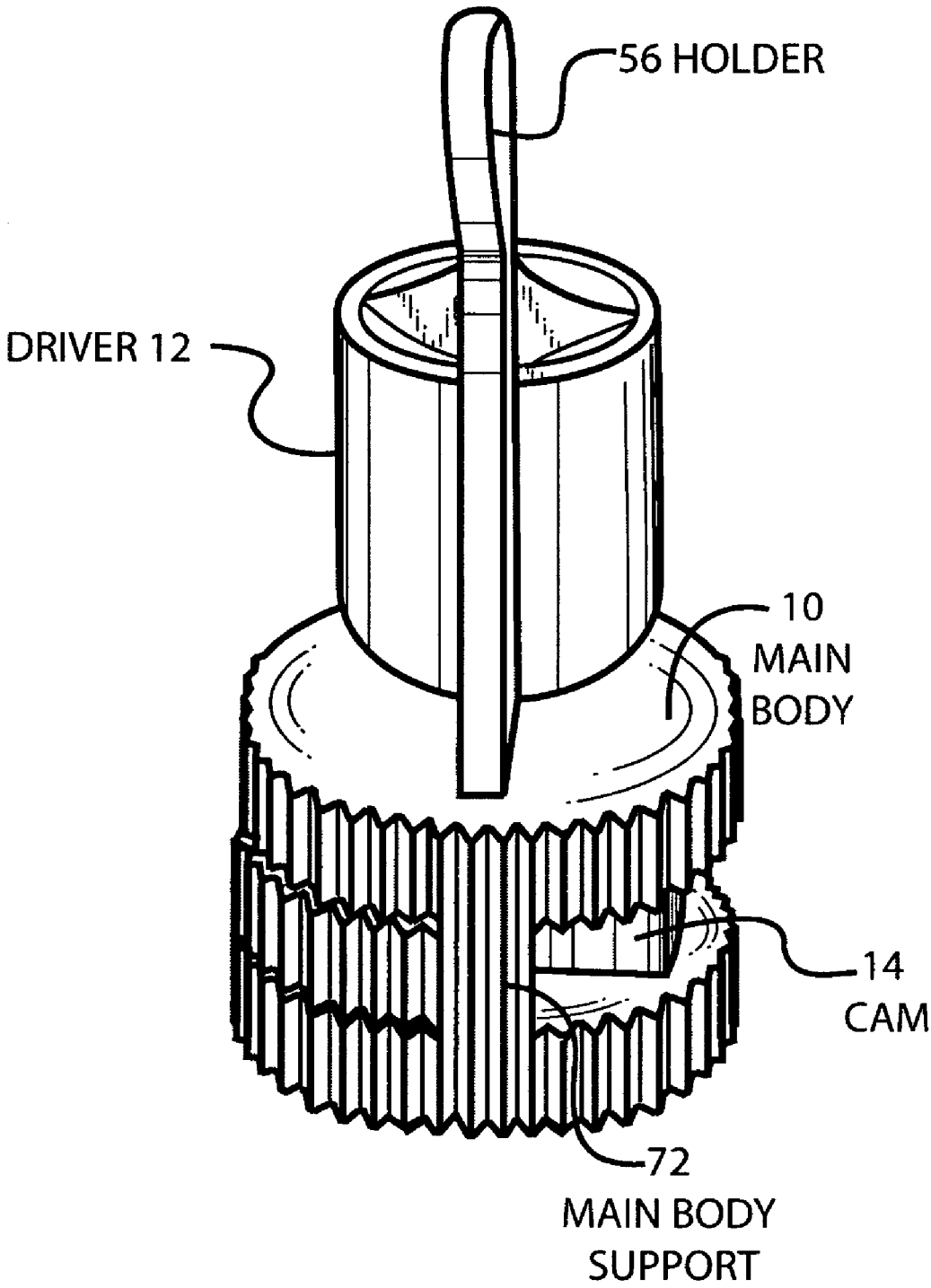
FIG. 16 is an isometric view of the assembled tool of the embodiment of FIG. 10 with the cam in a closed position.

FIG. 16 is an additional view of the tool shown in FIG. 15. As shown in FIG. 16, the cam 14 is rotated into a closed position within the main body portion 10. Rotation is achieved by using the driver 12. Holder 56 is used to hold the main body portion stationary with respect to the drain flange 30, and is attached to the upper flange of the main body portion 10. FIG. 16 illustrates the main body support 72 which connects the upper and lower flanges of the main body portion 10.

Figure 17:
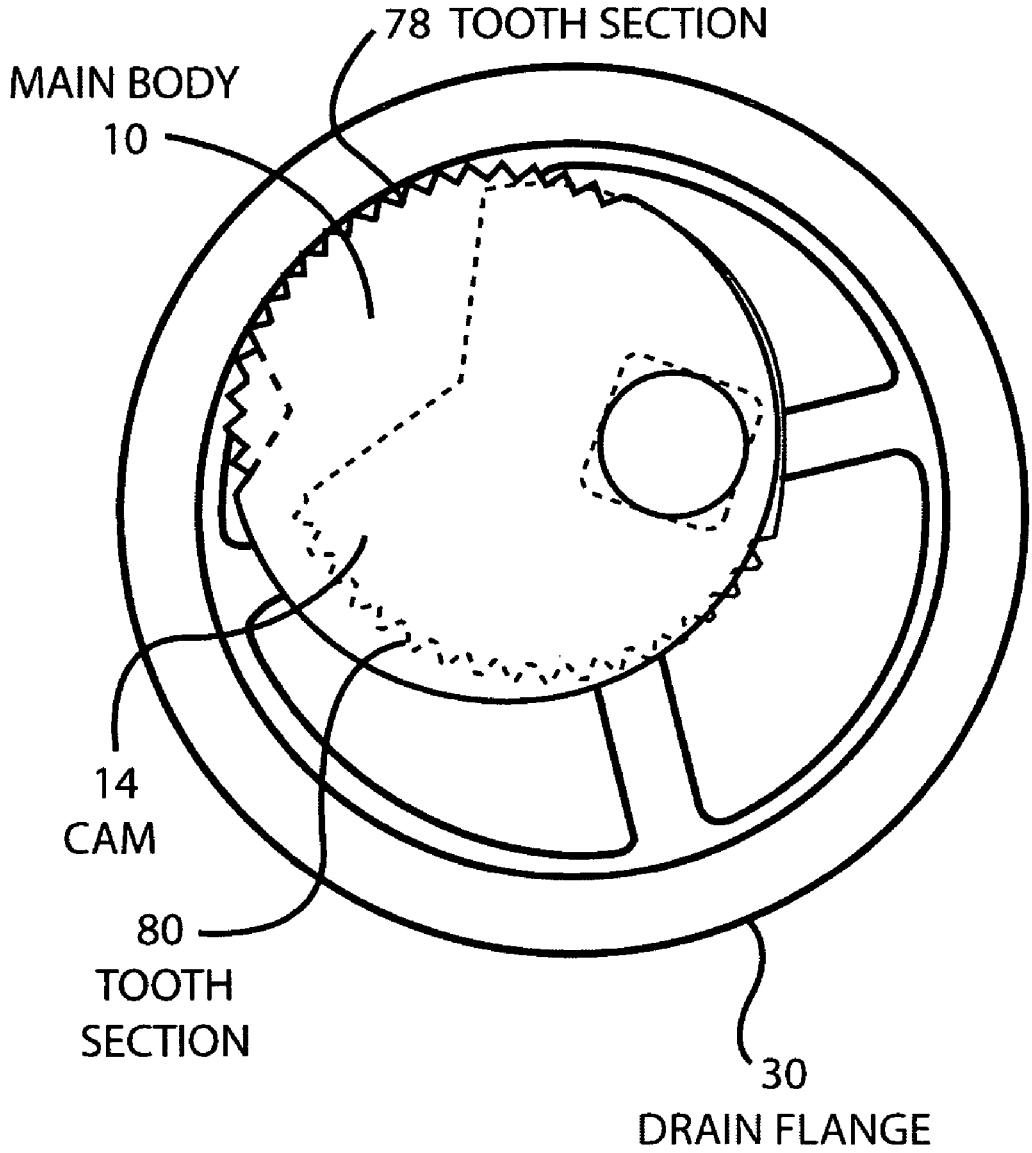
FIG. 17 is a schematic illustration of the embodiment of FIG. 10 inserted in a drain flange in a closed position.

FIG. 17 is a top view that schematically illustrates the manner in which the tool engages a drain flange 30. As shown in FIG. 17, the cam 14 is in a closed position in the main body portion 10. This allows insertion of the tool into the opening in the drain flange 30. As can be seen from FIG. 17, the cam 14 is capable of rotating in either direction in the slot of the main body 10 because of the clearance provided by the V-shaped opening in the cam 14. Tooth section 80 allows the cam to engage the drain flange 30 when the cam 14 is rotated in a counterclockwise direction. Similarly, tooth section 78 of the main body 10 also engages the inner surface of the drain flange 30.

Figure 18:
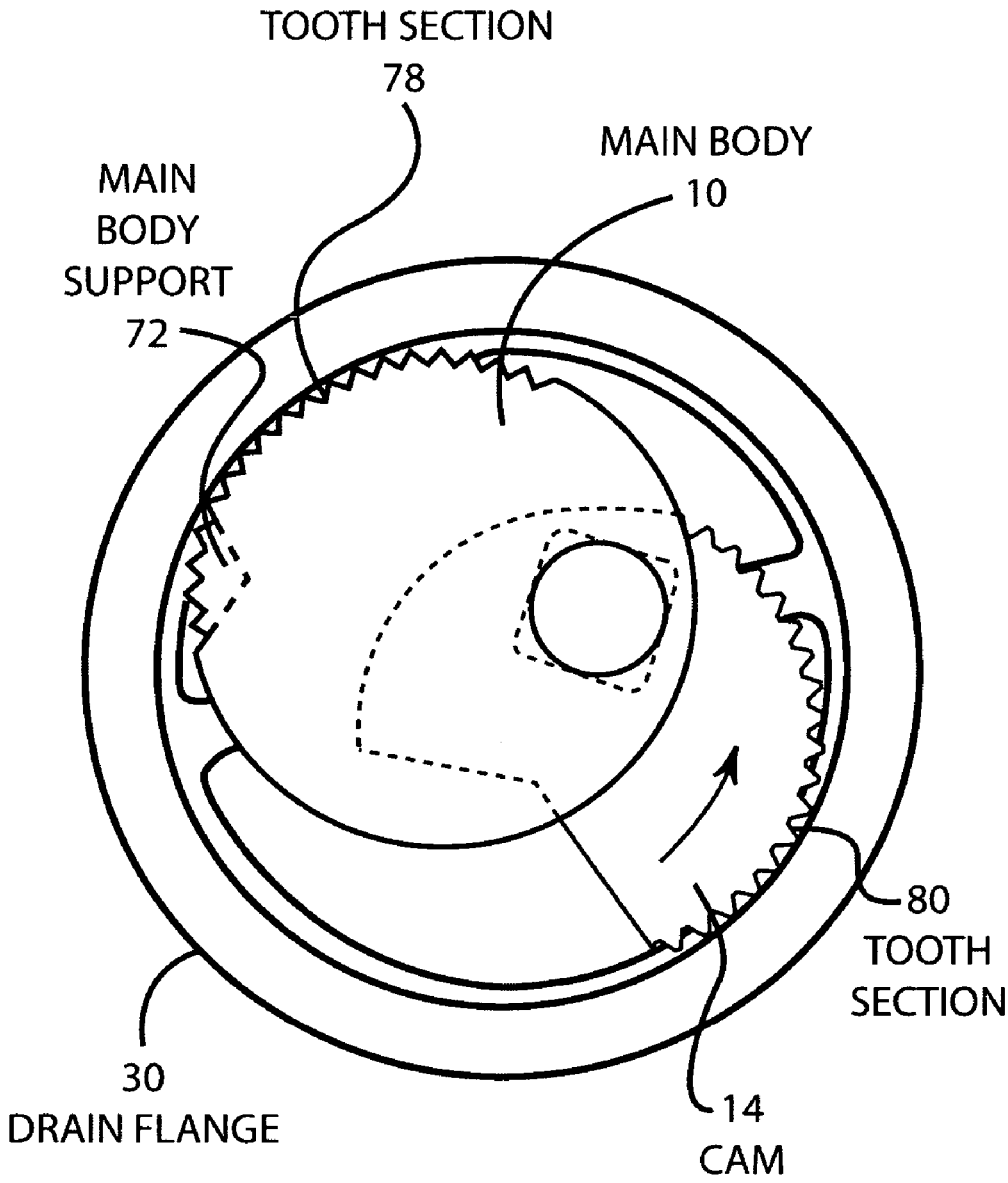
FIG. 18 is a schematic illustration of the embodiment of FIG. 10 inserted in a drain flange in an extended position.

FIG. 18 illustrates the cam 14 rotated into an extended position to engage the inner surface of the drain flange 30. As shown in FIG. 18, rotation of the cam 14 causes the tooth section 80 to engage the drain flange 30, as well as tooth section 78. A force is generated by rotation of the driver (not shown) between the main body 10 and the cam 14 by applying torque in a counterclockwise direction as shown by the arrow of FIG. 18. Main body support 72 is also shown in FIG. 18.

Figure 19:
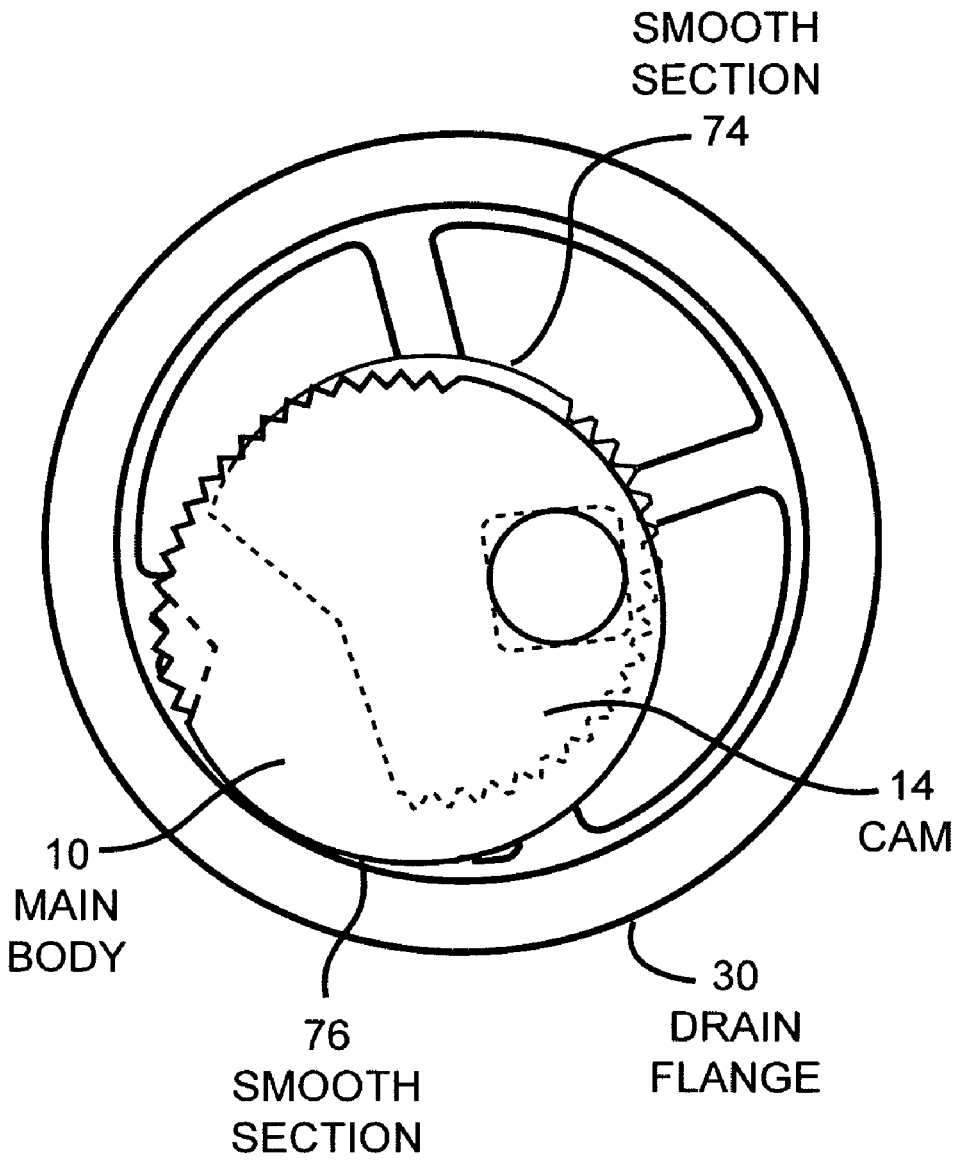
FIG. 19 is a schematic illustration of the embodiment of FIG. 10 inserted in a drain flange in a closed position.
Figure 20:
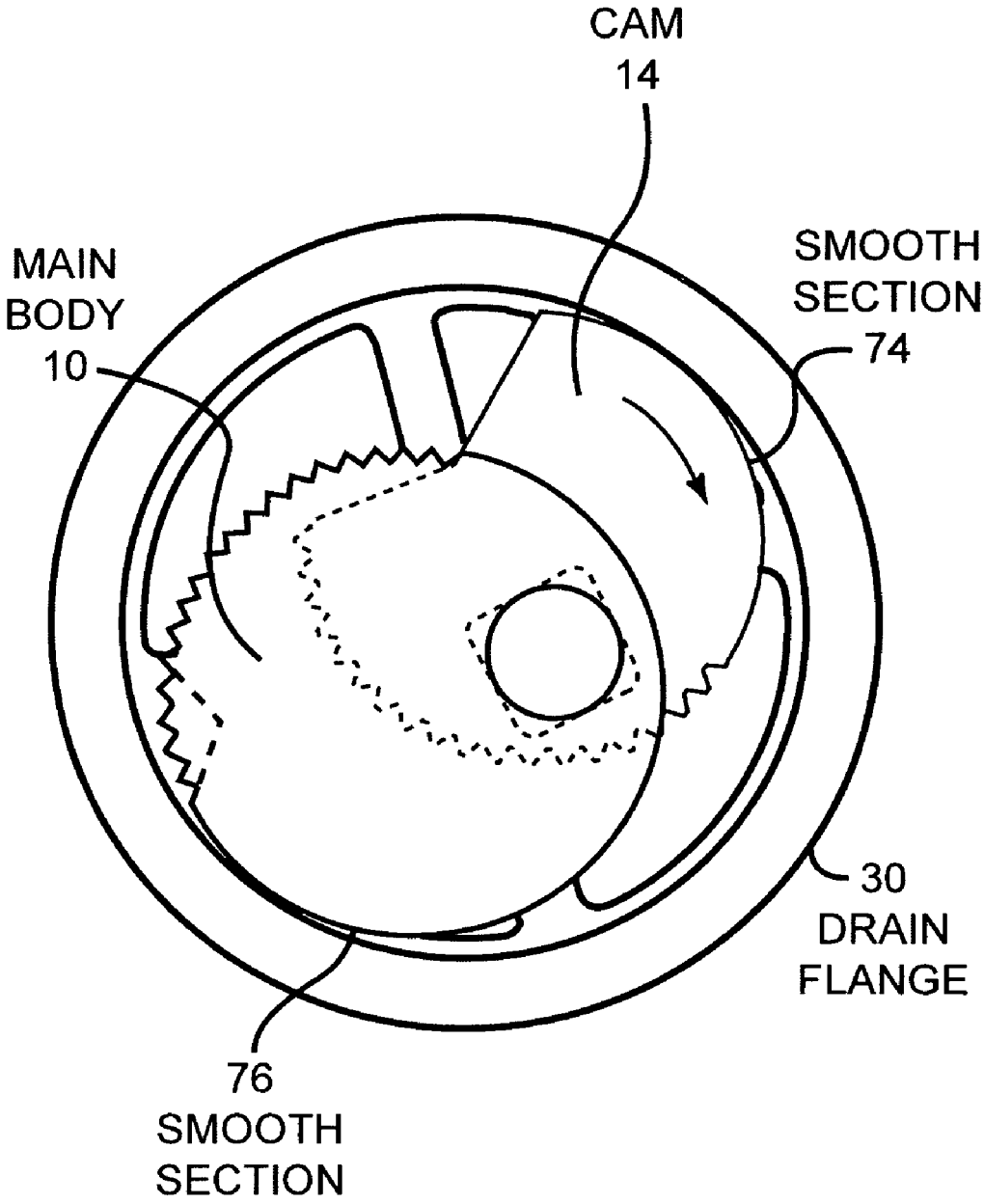
FIG. 20 is a schematic illustration of the embodiment of FIG. 10 inserted in a drain flange in a extended position.

FIGS. 19 and 20 illustrate the manner in which the tool can be used to insert a drain flange. The cam 14 illustrated in FIG. 19 is in a closed position and has a smooth section 74. In addition, main body 10 has a smooth section 76. In the closed position, the tool easily fits inside the interior of the drain flange 30. FIG. 20 illustrates the cam 14 rotated to an extended position such that the smooth section 74 of the cam 14, as well as the smooth section 76 of the main body 10, engage the inner surface of the drain flange 30. This occurs by applying torque in the clockwise direction, as indicated by the arrow, to rotate the cam 14 in a clockwise direction. Smooth surfaces 74 and 76 prevent the drain flange from being scared or marred during insertion of the drain flange. These smooth sections can be coated with a rubberized material or a sleeve can be applied to these sections to add resistance and further prevent marring or scaring of the drain flange inner surface 30.

Figure 21:
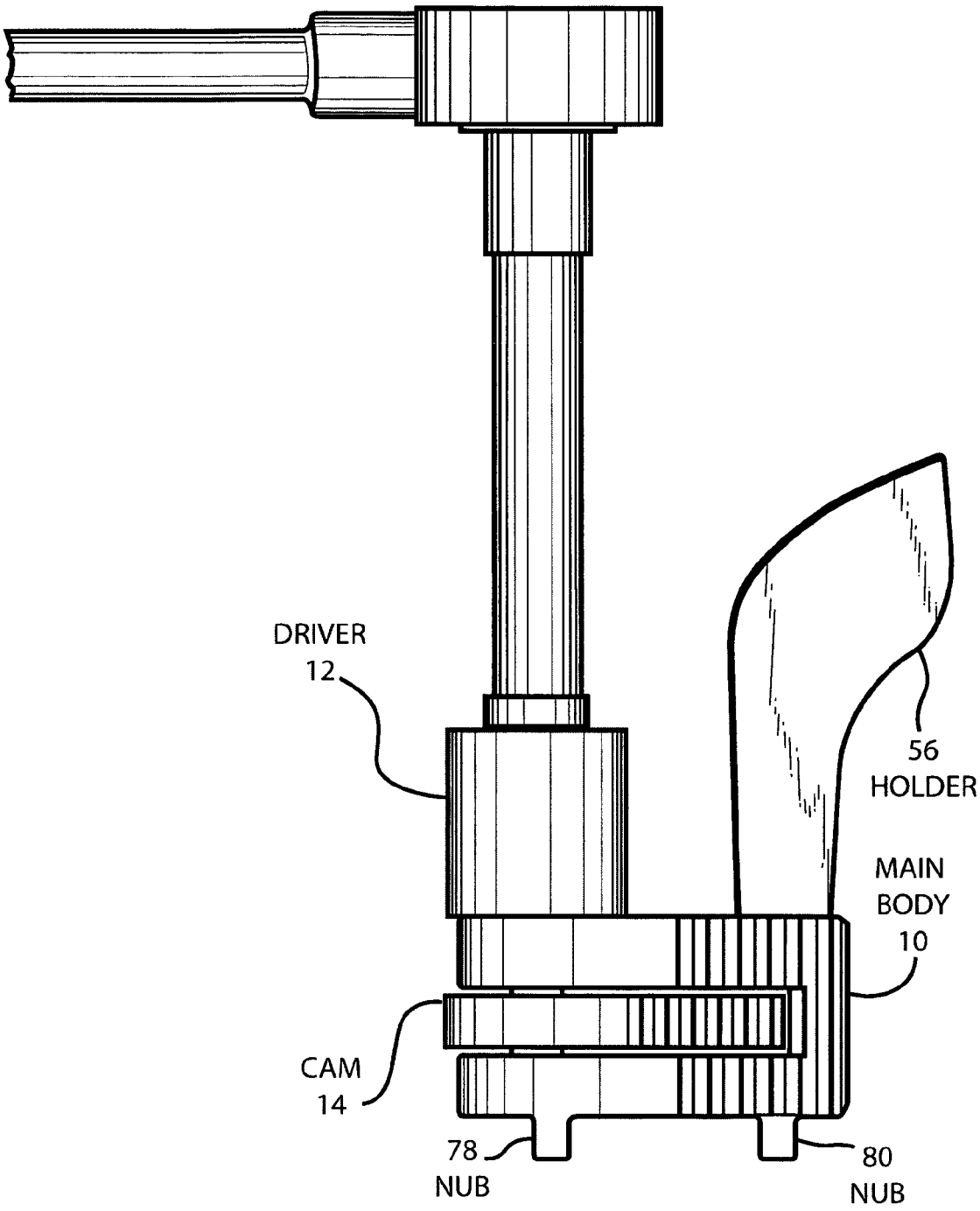
FIG. 21 is a side view of another embodiment illustrating multiple engagement nubs that engage arms on the drain flange.

FIG. 21 is a side view of another embodiment that includes multiple nubs. The main body 10, the cam 14 and the driver 12 are illustrated in FIG. 21. Also illustrated in FIG. 21 are nub 78 and nub 80. Nub 78 and nub 80 are capable of engaging the arms of the drain flange 30, such as illustrated in FIG. 19. These arms typically connect at the bottom of the drain flange 30, as shown in FIG. 19. Although two nubs are shown, four nubs or any other desired number of nubs can be used to engage four arms that are normally used in drain flanges or other number of arms in a drain flange. These nubs assist in both the insertion and extraction of the drain flange. Rotational torque is applied using the driver 12 to either insert or remove the drain flange. The tool can be rotated using the holder 56 in the drain flange so that the nubs 78, 80 engage the arms at the point at which the cam 14 and main body 10 engage the inner surface of the drain flange. In this manner, the tool will be allowed to adequately engage the drain flange and create the maximum resistance required to remove a drain flange.

Figure 22:
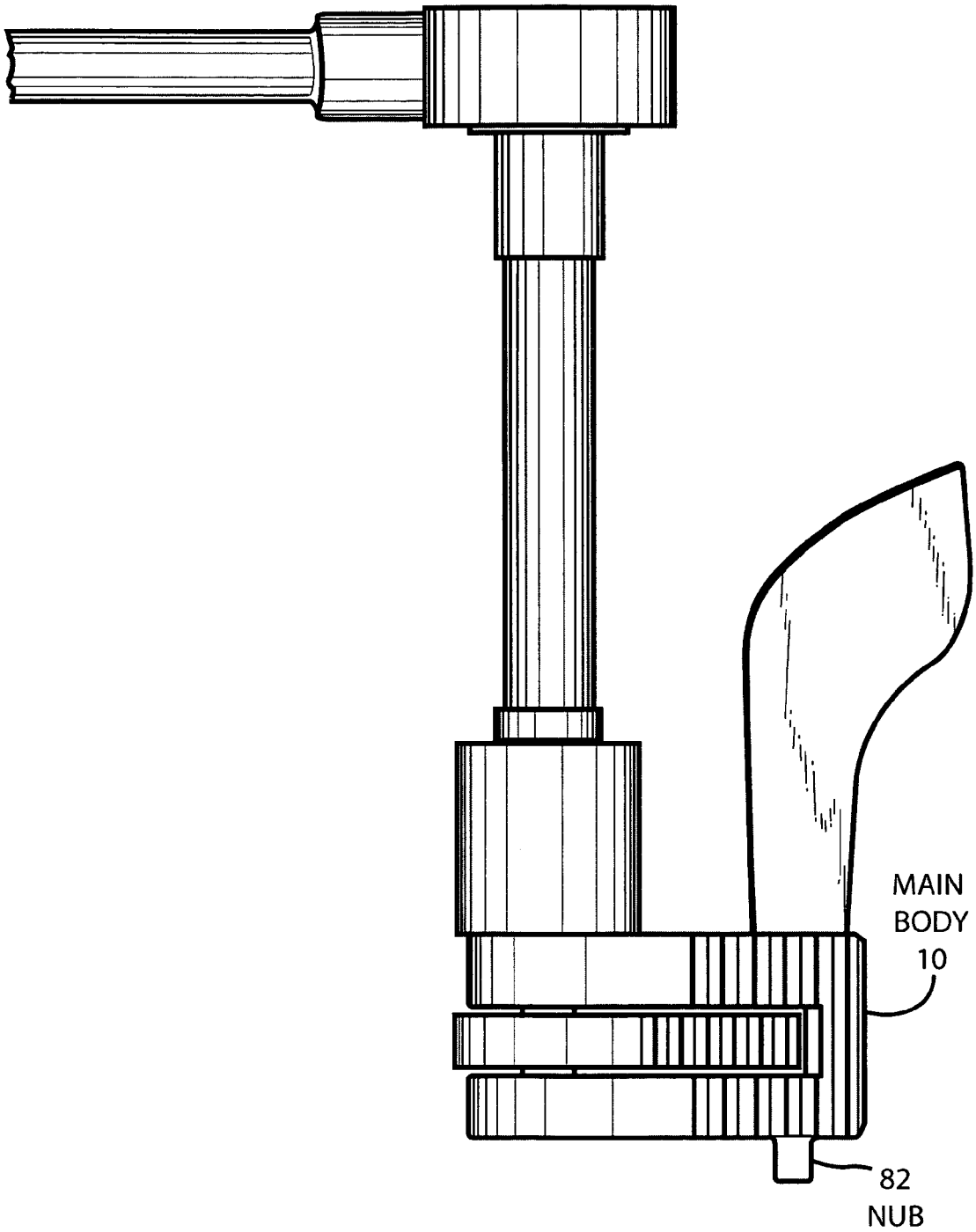
FIG. 22 is a side view of another embodiment having a single engagement nub.

FIG. 22 illustrates an additional embodiment in which a single nub 82 is attached to the main body 10. The embodiment illustrated in FIG. 22 is especially useful in the process of extracting drain flanges and inserting new drain flanges where preserving the finish, without damage, is desirable. The embodiment of FIG. 22 accomplishes this function in a unique fashion, which is different from the manner in which the embodiment of FIG. 21 operates using two or more protrusions. As the arm width, location and angles vary in the drain flanges from one manufacture to another, it may be difficult to line up two or more nubs with two or more spokes or arms on the drain flange. As shown in FIG. 22, a single protrusion (nub 82) is utilized. The use of a single protrusion guarantees penetration in all web designs since the tool can be positioned in the drain flange to engage an arm regardless of the size, thickness or angular orientation of the arm. When the main body of portion 10 is rotated around the axis of the nub 82 in a clockwise direction, for assembly, as a result of application of torque by the driver in a clockwise direction, the main body portion 10 engages the inner surface of the drain flange. When the main body portion 10 is rotated around the axis of the nub 82 in a counterclockwise direction, for disassembly, as a result of application of torque by the driver in a counterclockwise direction, the main body portion, as well as the cam, engage the inner surface of the drive flange. This process is described in more detail below with respect to FIGS. 25 and 26.

As the nub 82 engages an arm of the web of the drain flange as a result of torque being applied to the driver, the cam will open and engage the inner surface of the drain flange. The finger hold illustrated in FIG. 22 can also be used to maintain the position of the main body portion so that the cam and body portion sufficiently engage the inner surface of the drain flange. Either the nub 82, or a finger hold, as shown in FIG. 22, or both, can be used to hold the body portion in a substantially stationary position so that the cam can be rotated and engage the inner surface of the drain flange with sufficient force so that the teeth penetrate the inner surface of the drain flange and create torque to rotate the drain flange. In other words, the help needed to cause the tool to lock-up in the drain flange can be provided by either a nub, that engages an arm of the web of the drain flange, or by using a finger hold, or both. Of course, the teeth must be sharp enough to penetrate the surface of the drain flange, including chrome coatings that may exist on that inner surface. Cast teeth or ridges may not be sharp enough to penetrate a hard surface such as a chrome surface. In such cases, carbide can be flame sprayed onto cast teeth or ridges to create sufficient sharpness and hardness to engage such hard surfaces of the drain flange. In that regard, there are essentially three ways of forming the teeth on both the body portion and the cam. First, the teeth may be machined which creates very sharp surfaces. Secondly, the edges may be knurled. The process of knurling can create very sharp edges, also. The third process is the process of flame spraying in which high temperature molten materials are sprayed onto the surface, such as a carbide material. If teeth are cast into the main body portion or the cam, the desired sharpness may not be obtained, even when using investment casting techniques. Hence, flame spraying of carbide onto cast teeth or ridges can create sufficient sharpness and hardness on the surfaces of the cam and the main body portion to adequately engage hard surfaces on the inner portion of the drain flange, such as chrome coated surfaces.

Figure 23:
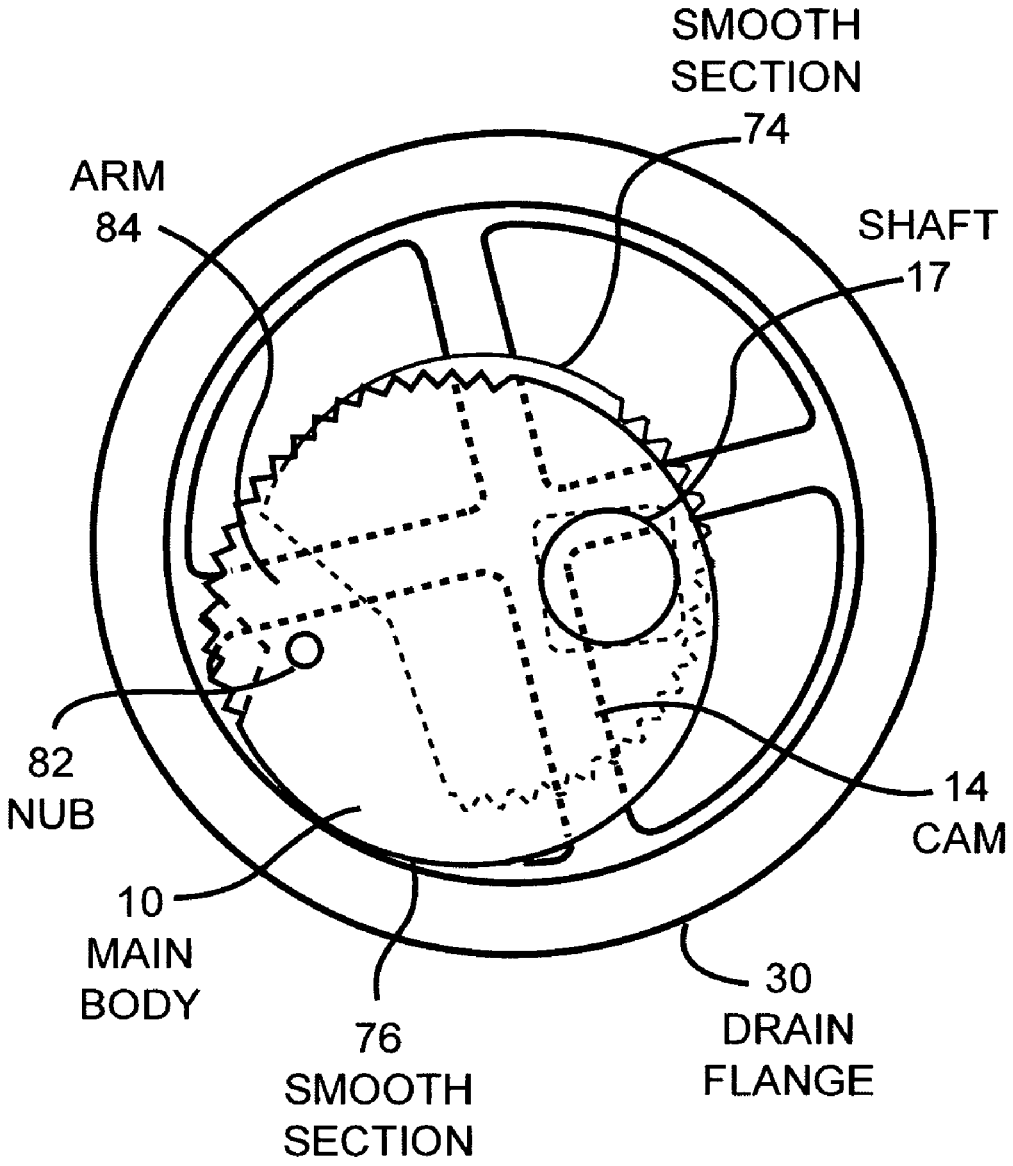
FIG. 23 is a schematic top view of the embodiment of FIG. 22 inserted in a drain flange in a closed position that is being used to tighten the drain flange.

As shown in FIG. 23, a clockwise torque is applied to shaft 17 which causes the main body portion 10 to slide within the interior portion of the drain flange 30 until the nub 82 engages an arm, such as arm 84, of drain flange 30. As nub 82 engages the arm 84, the smooth section 76 of the main body 10 engages the inner surface of the drain flange 30. Cam 14 having smooth section 74 then begins to rotate in a clockwise direction.

Figure 24:
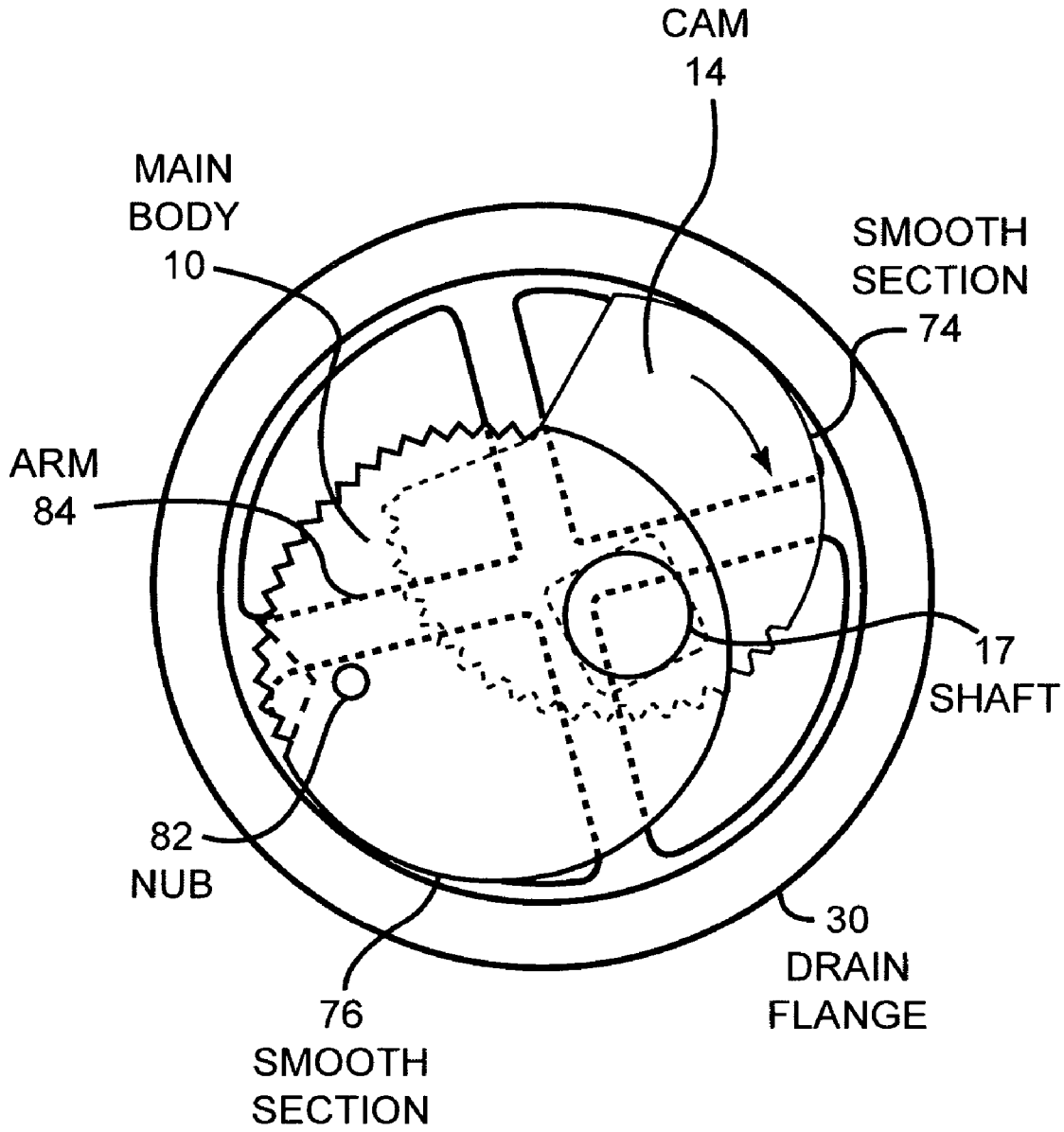
FIG. 24 is another schematic top view of the embodiment of FIG. 22 inserted in a drain flange in an open position that is being used to tighten the drain flange.

As shown in FIG. 24, the cam 14 rotates in a clockwise direction until the smooth section 74 engages the inner surface of the drain flange 30. The smooth section 76 of the main body portion also engages the inner surface of the drain flange 30. Since both of the smooth sections 76 and 74 engage the inner surface of the drain flange, minimal damage to the inner surface of the drain flange occurs. The torque applied to the shaft 17 then causes the nub 82 to apply a rotational torque to the drain flange 30 in a clockwise direction. This causes the drain flange to rotate in a clockwise direction for assembly without causing any damage to the inner surface and finish of the drain flange 30. The smooth section of both the main body 10 and the cam 14 can also be coated with a soft material such as rubber and plastic to further reduce scarring or scratching. In addition, a soft elastic band can be placed around the circumference of the tool that expands with the extension of the cam 14 to provide a soft surface that will also prevent the scratching or marring of the interior surface of the drain flange 30 during insertion.

Figure 25:
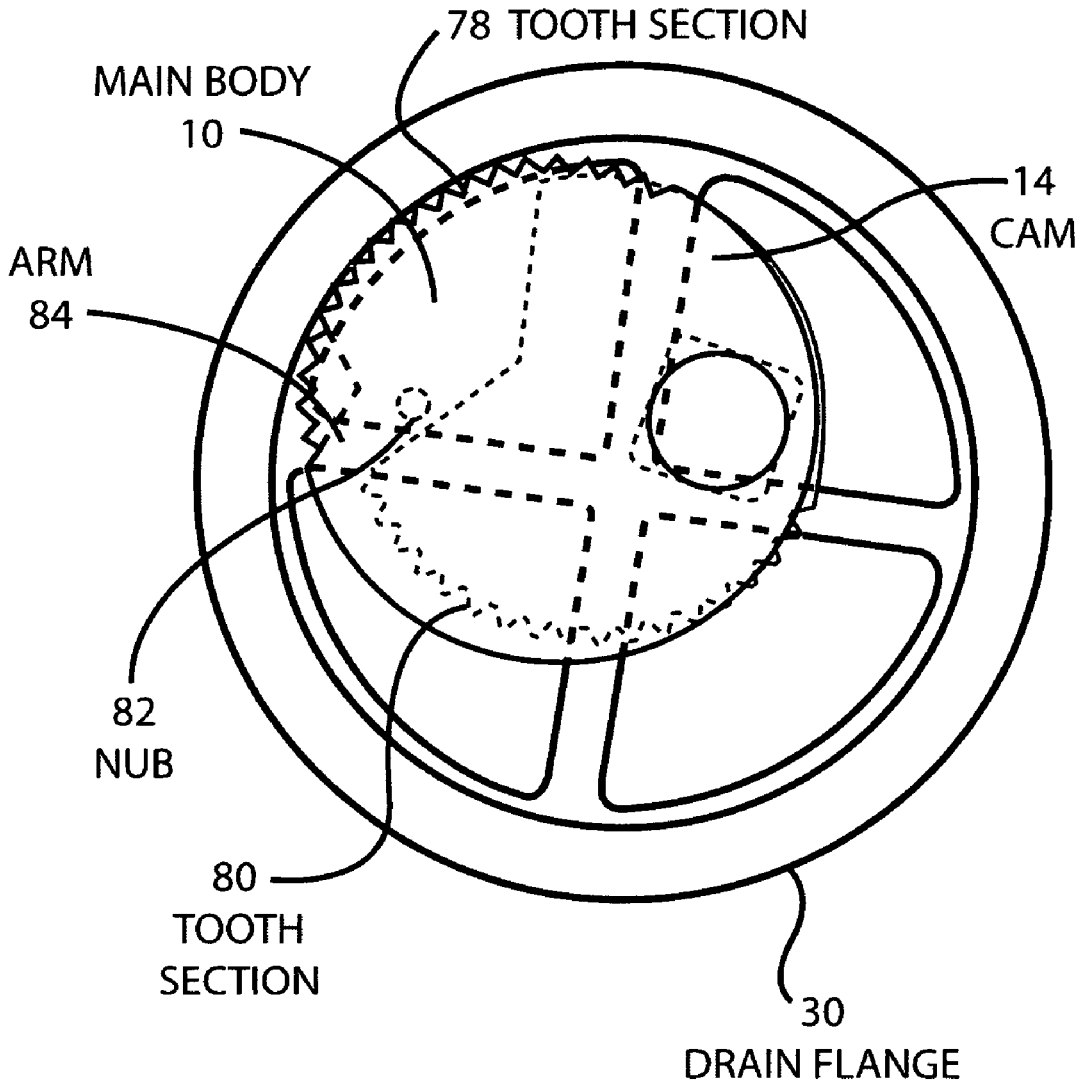
FIG. 25 is another schematic top view of the embodiment of FIG. 22 that is inserted in a drain flange in a closed position that is being used to open a drain flange.

FIG. 25 is an illustration of the embodiment of FIGS. 22 through 24 that illustrates the manner in which the tool can be used to loosen or extract a drain flange 30. As shown in FIG. 25, the cam 14 is in the retracted position inside the main body 10 and inserted into the drain flange 30. The main body 10, as shown in previous drawings, has a tooth section 78. Cam 14 also has a tooth section 80. The nub 82 is shown resting against an arm 84 of the drain flange 30.

Figure 26:
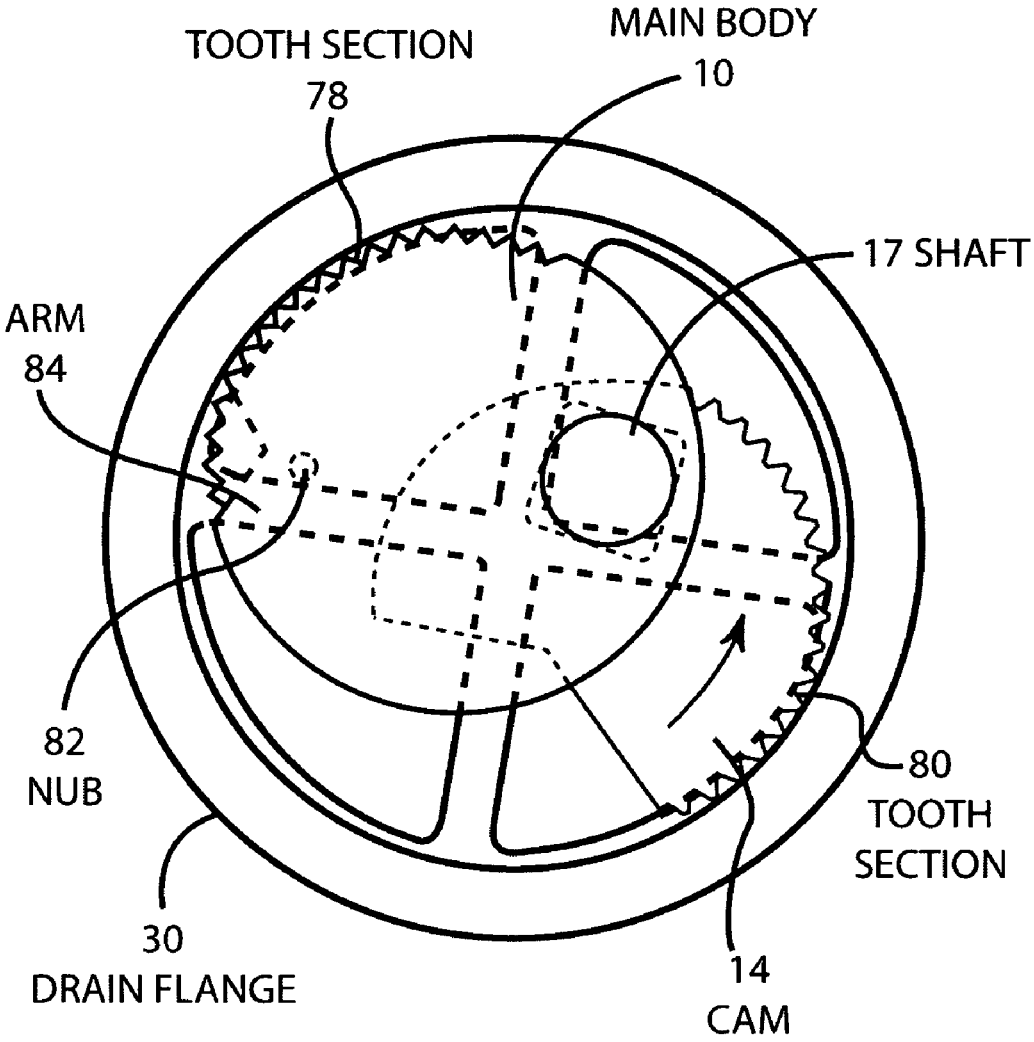
FIG. 26 is another schematic top view of the embodiment of FIG. 25 in an open position.

FIG. 26 is a further illustration of the embodiment shown in FIGS. 22 through 25. As shown in FIG. 26, a counterclockwise force has been applied to the shaft 17 (FIG. 24) to cause the cam 14 to rotate in a counterclockwise fashion. The nub 82 that is connected to the main body 10 rotates in a counterclockwise direction until the nub 82 rests against and is forced against arm 84. At the same time, the tooth section 80 of cam 14 and the tooth section 78 of main body 10 engage the inner surface of the drain flange 30. The teeth 78 and 80 engage and create friction between the tool and the drain flange 30 and create a rotational force in a counterclockwise direction. In addition, nub 82 creates a counterclockwise force on arm 81. Hence, there is a distribution of torque between the tooth section 78 of the main body portion, the tooth section 80 and the nub 82. Engagement of the cam reduces the torque that is applied by nub 82 that is necessary to remove the drain flange 30 from a drain shoe (not shown). This reduction and distribution of force between the nub 82 and the tooth sections 78, 80 is instantaneous and automatic, and reduces the torque applied by the nub 82 to prevent breaking of the arm 84. In addition, this distribution of force reduces the forces applied by the cam 14 and main body portion 10. This reduction in the forces applied by the cam 14 avoids ovaling and breaking of the drain flange 30 during removal since some of the torque required to remove the drain flange 30 is generated by nub 82. Hence, the torque is shared between the cam 14, main body portion 10 and the nub 82. If the arm 84 begins to fail, more force will be applied by the cam 14 and the main body portion 10 to insure that the drain flange 30 is removed.

As also shown in FIG. 26, the location of the nub 82 is essentially opposite to the location of the shaft 17 on the main body 10, which is the pivot point for the cam 14. By placing the nub 82 at the opposite location on the main body 10, the maximum amount of leverage by the tool and the maximum ability to open the cam 14 by the tool is created.

The embodiment of FIGS. 22 through 26 will work with any design of arms in a drain flange 30 regardless of size or shape. As shown in later embodiments, angled tooth designs can be used to assist in engaging inner surface of the drain flange 30 and can be used with any of the embodiments illustrated herein.

Figure 27:
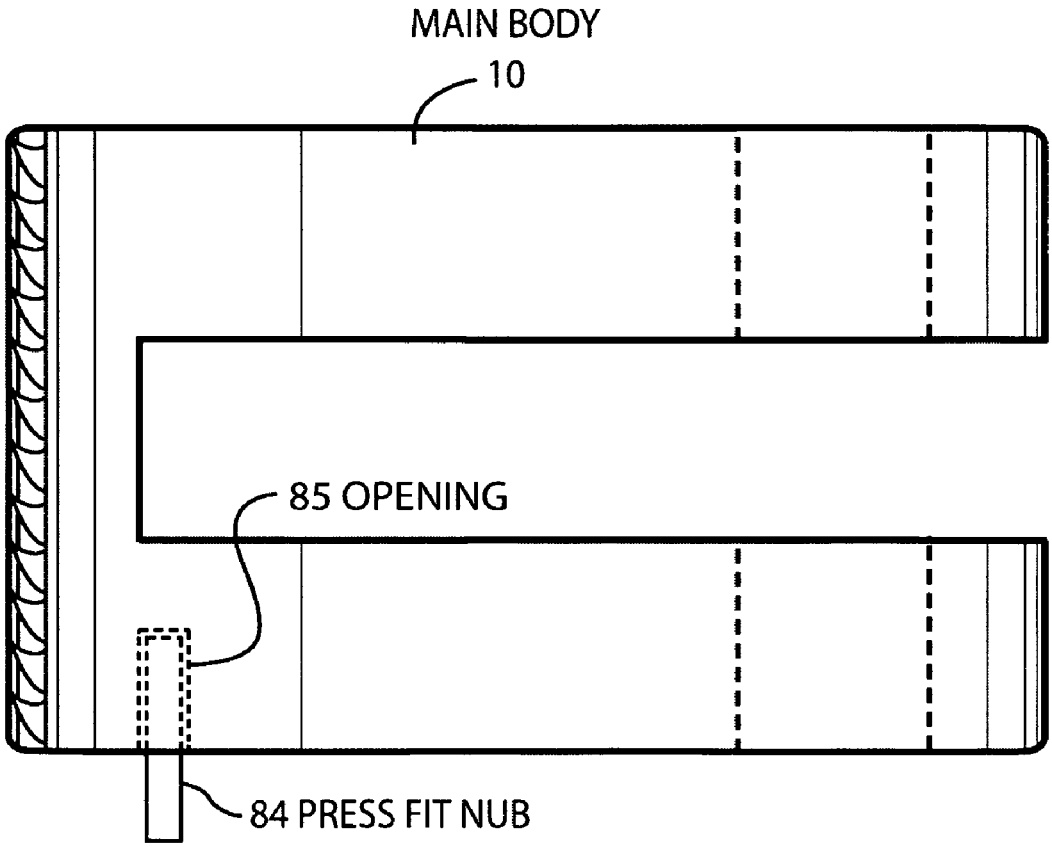
FIG. 27 is a side view of an embodiment of the main body using a press fit nub.

FIG. 27 illustrates one embodiment for inserting a nub. As shown in FIG. 27, the nub 84 is press fit into the main body portion 10. In other words, the nub 84 is inserted in an opening 85 in main body 10 by forcing the nub 84 into the opening 85. The tolerances of the nub 84 and the opening 85 are such that desired degree of force is required to press fit the nub 84 into the opening 85.

Figure 28A:
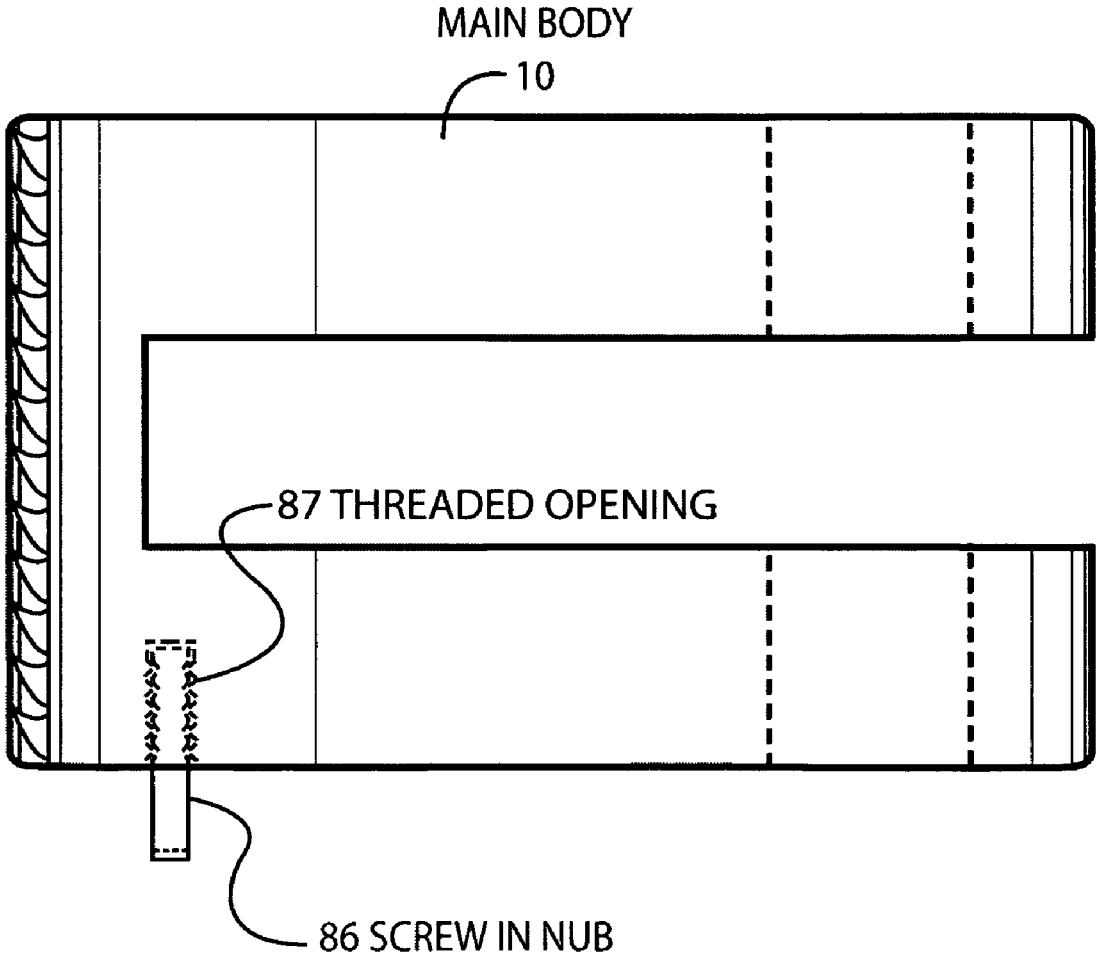
FIGS. 28A and 28B are side views of an embodiment of the main body using a screw-in nub.

FIG. 28A illustrates another embodiment for inserting a nub 86. As shown in FIG. 28, nub 86 has screw threads that screw into a threaded opening 87 in the main body 10. The nub 86 can be inserted with the desired degree of torque to insure that the nub 86 does not accidentally loosen during use.

Figure 28B:
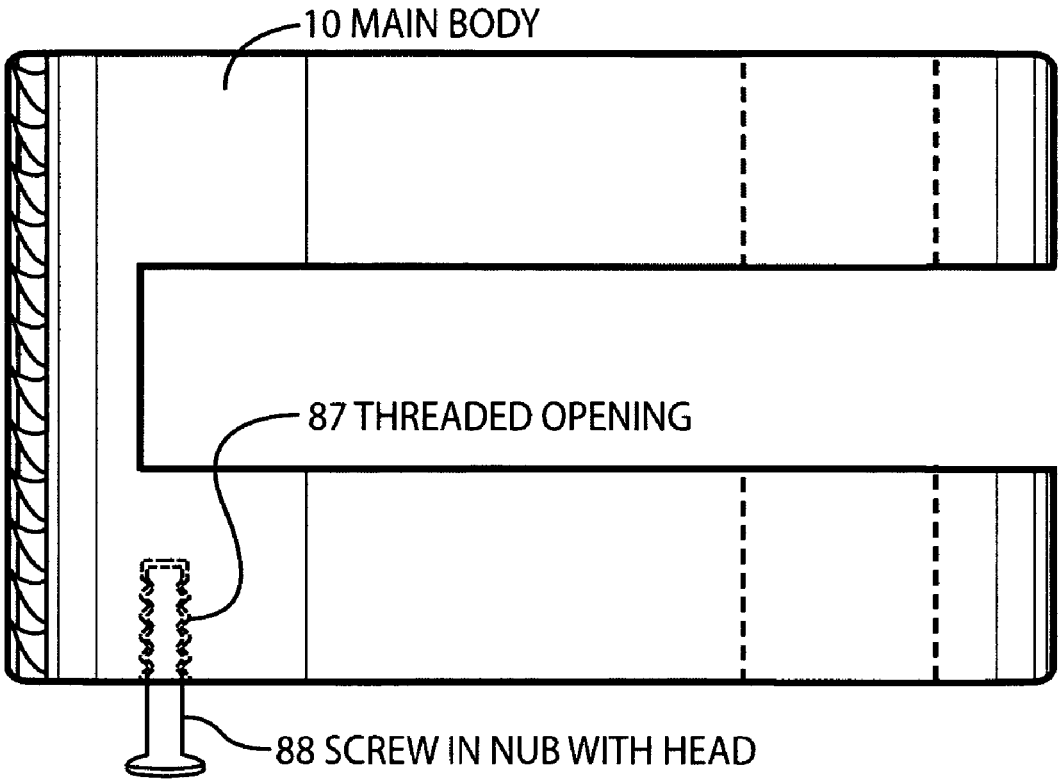

FIG. 28B shows an additional embodiment in which the nub 8g comprises a screw 88 with a screw head. The screw 88 is screwed into a threaded opening 87 in the main body 10.

Figure 29:
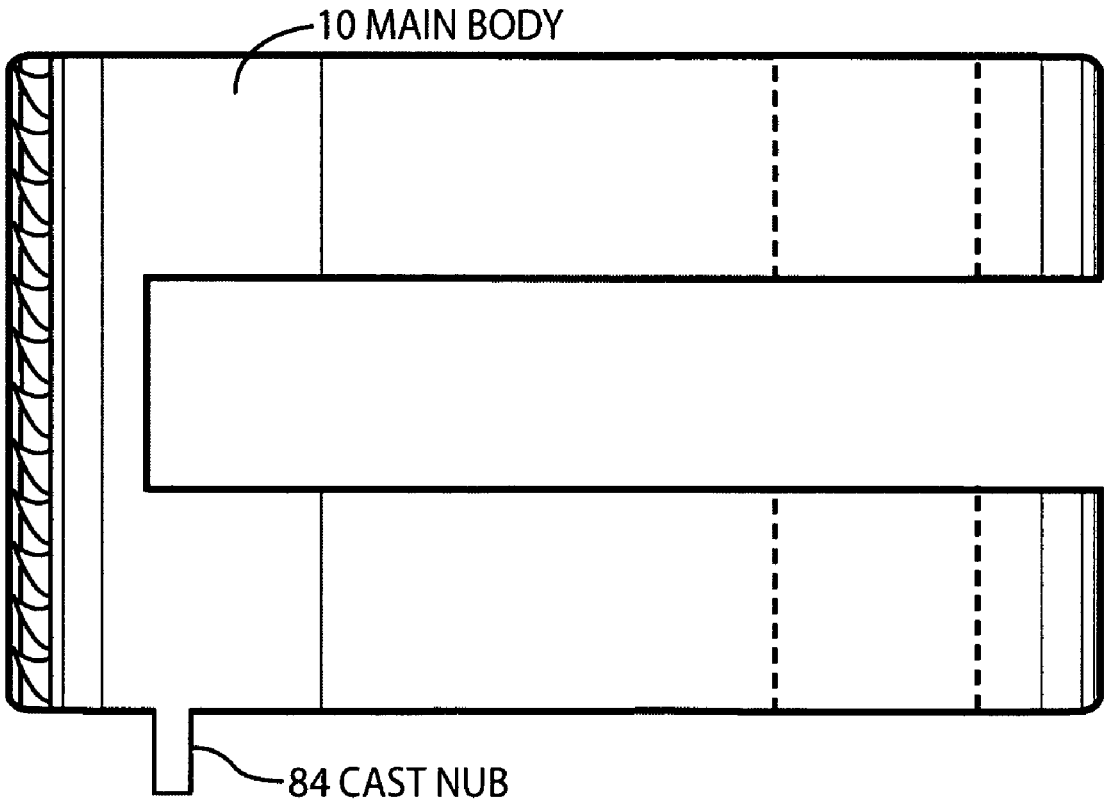
FIG. 29 is a side view of an embodiment having a cast nub.

FIG. 29 shows an additional embodiment in which the nub 89 is cast as part of the main body 10. The cast nub 89 has sufficient strength to apply the forces created by the tool and forms a portion of the main body 10.

Figure 30:
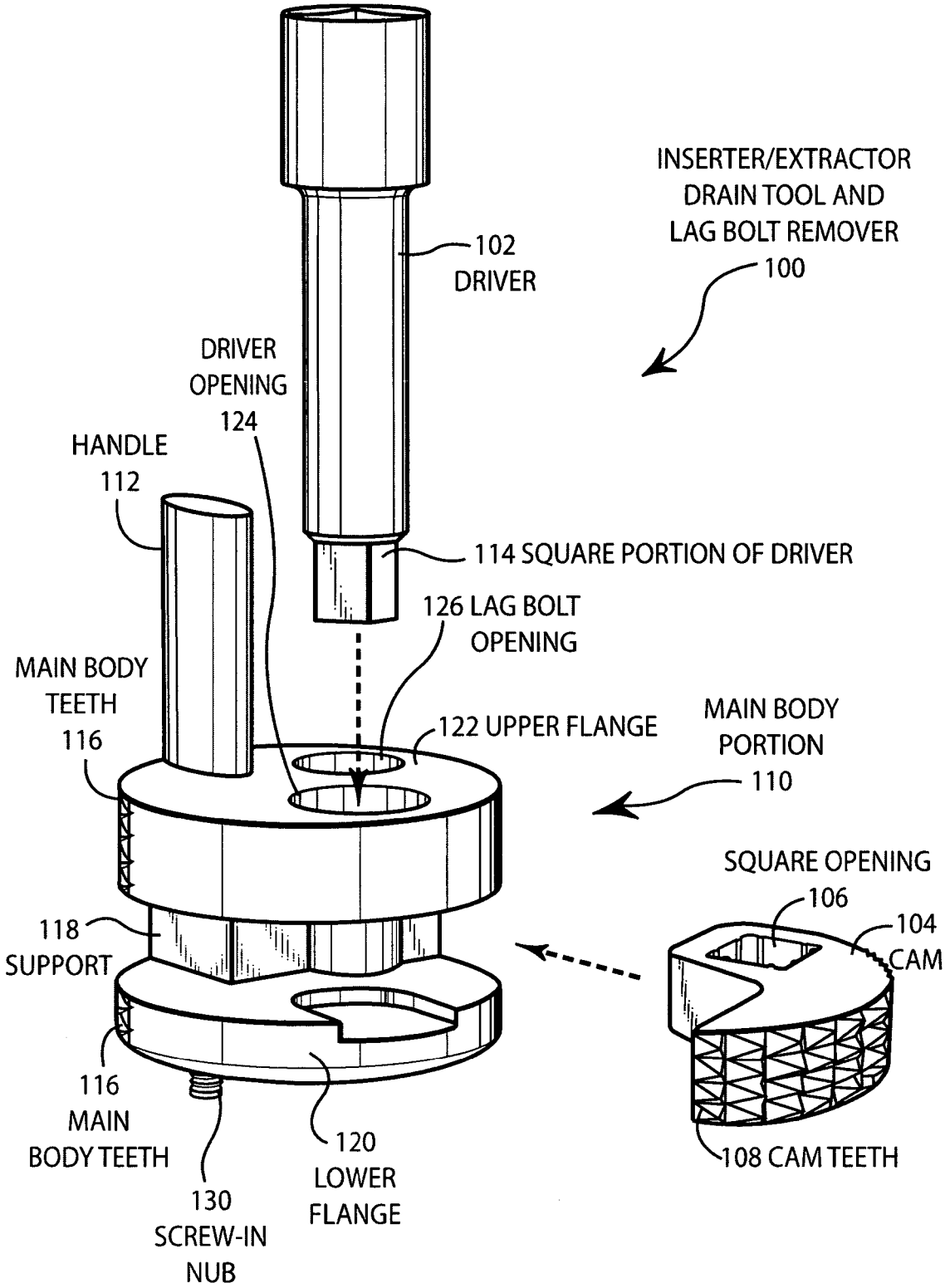
FIG. 30 is an isometric assembly view of another embodiment.

FIG. 30 illustrates an additional embodiment 100 of an inserter/extractor drain tool and lag bolt remover. The inserter/extractor 100 includes a driver 102 that has a square portion 114. The corner to corner distance of the square portion 114 does not exceed the diameter of the round shaft portion of the driver 102. The round shaft portion of driver 102 is inserted and rotates in the driver opening 124. The driver 124 has a sufficient diameter to allow the round shaft portion of the driver 102 to be inserted in driver opening 124 and easily rotate while being held sufficiently tightly that the driver 102 does not bind within the driver opening 124 when torque is applied to the driver 102. The square portion 114 of the driver 102 is inserted in the driver opening 124 and is inserted in the square opening 106 of cam 104. The cam 104 is inserted in the main body portion 110 between the upper flange 122 and the lower flange 120. The square portion 114 is held tightly in the square opening 106 of cam 104 by being either press fit into the square opening 106 or retained in any other desired fashion such as by welding, braising, the use of a detent ball as shown in previous embodiments, gluing, etc.

FIG. 30 also illustrates a lag bolt opening 126 in the main body portion 110. Handle 112 is also connected to the main body portion 110 to assist in holding the main body portion in position and handling the inserter/extractor tool 100. Main body portion 110 also has teeth 116 around a predetermined portion of the exterior surface. The main body teeth 116 and cam teeth 108 on cam 104 engage the interior surface of the drain flange during extraction of a drain flange. Likewise, the smooth source portions of the main body portion 110 engage the interior surface of the drain flange when the inserter/extractor 100 is being used for insertion of a drain flange.

As disclosed above with respect to FIG. 30, the main body portion 110 has an upper flange portion 122 and a lower flange portion 120. These flange portions are connected together by a support 118 that provides structural rigidity to the main body portion 110. A nub 130, such as a screw-in nub, can be attached to, or formed as part of, the lower flange portion 120. In the same manner as described above, the nub 130 has a position on the main body portion 110 that is opposite of the driver opening 124 to maximize the leverage of the inserter/extractor tool 100 when either inserting or extracting a drain flange.

Figure 31:
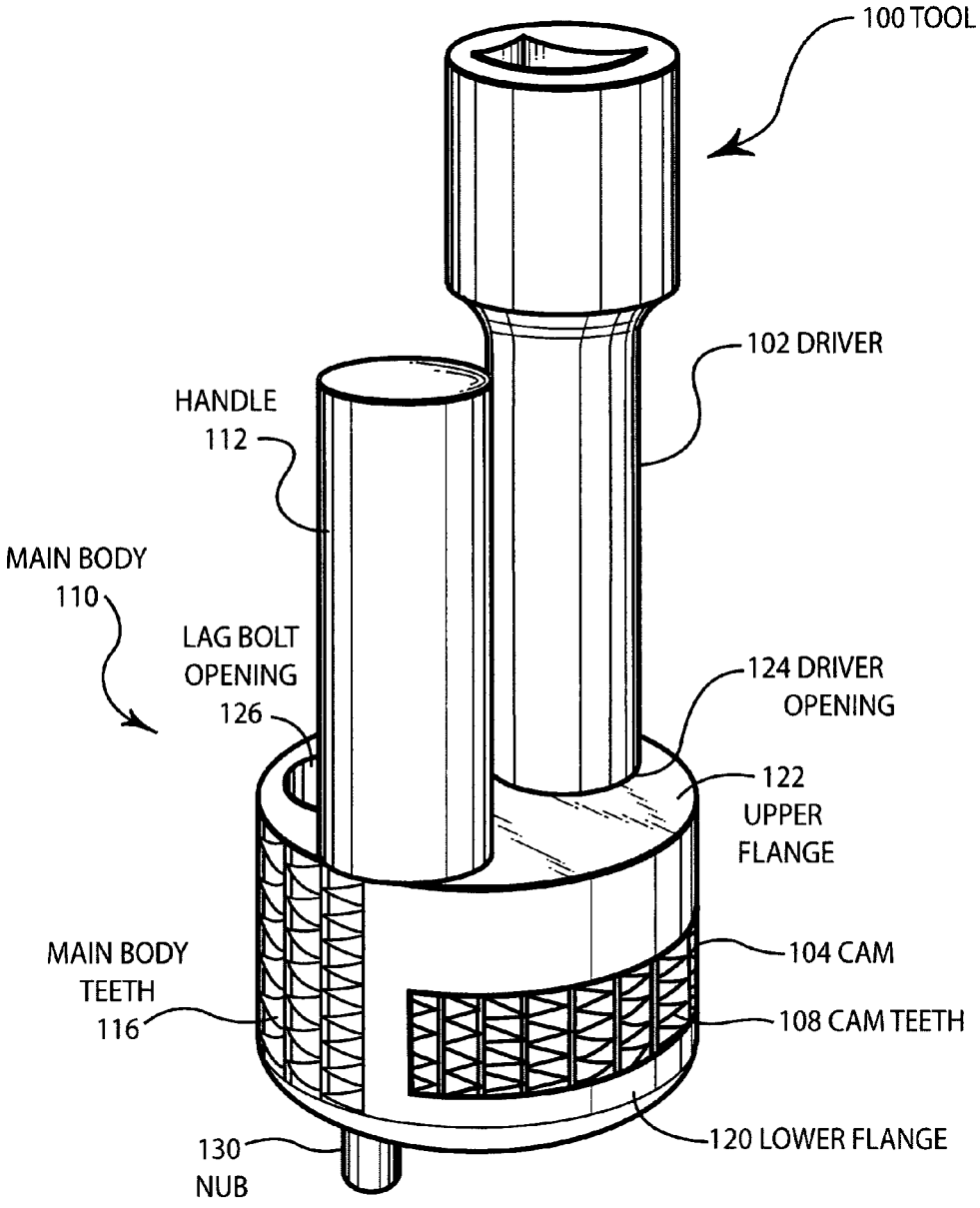
FIG. 31 is an isometric view of the assembled tool of the embodiment of FIG. 30 showing the tool in a closed position.
Figure 32:
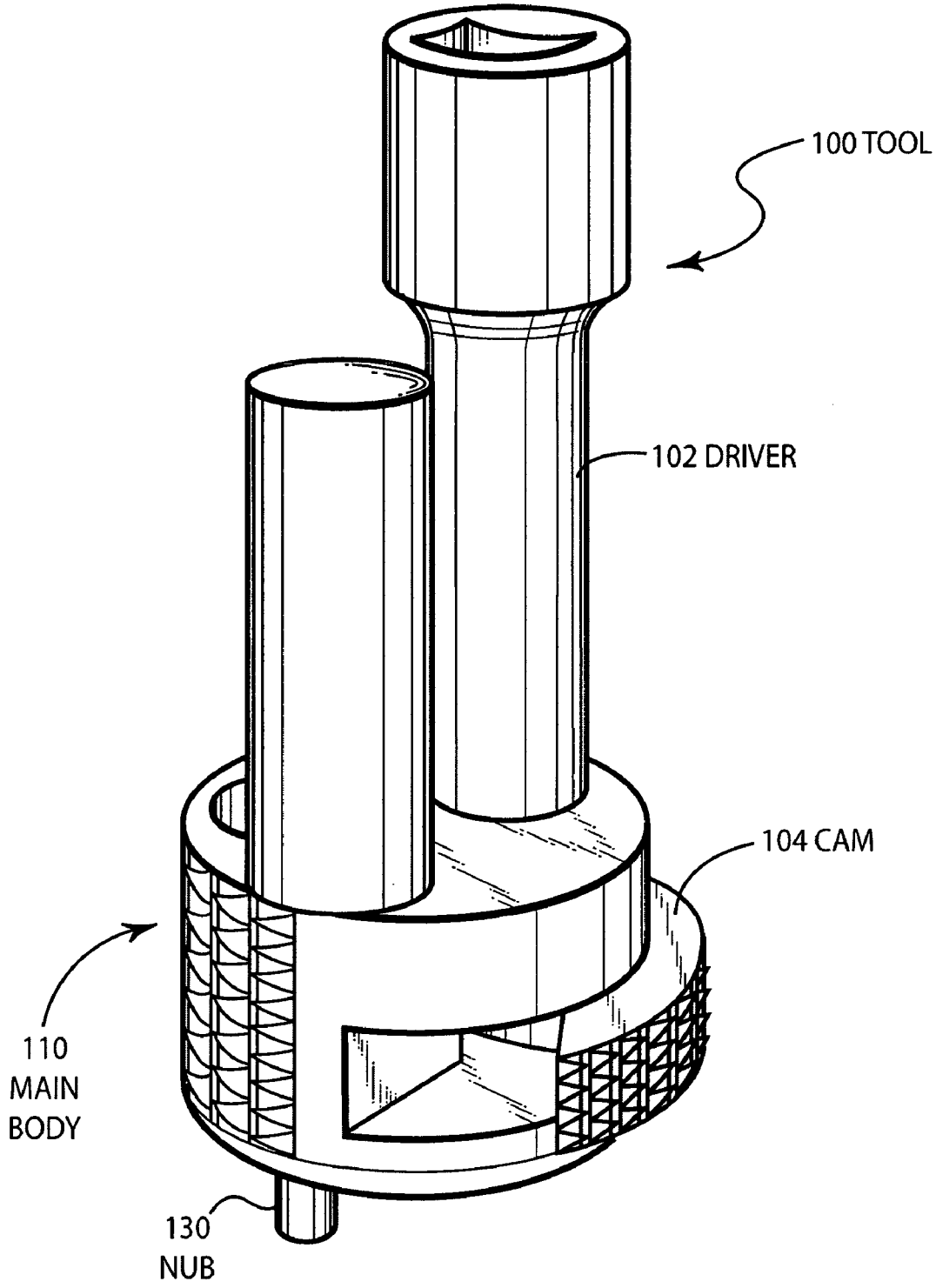
FIG. 32 is an isometric view of the assembled tool of the embodiment of FIG. 30 in a partially open position.

FIG. 31 is an additional isometric view of the embodiment of FIG. 30 showing the tool 100 in an assembled and closed position. As illustrated in FIG. 31, the driver 102 is inserted through the driver opening 104 which allows the round shaft portion 102 to rotate in the driver opening 124 that exists in the upper flange 122 of the main body 110. The driver 102 has a square portion 114 (FIG. 30) that is inserted into the square opening 106 (FIG. 30) of cam 104 so that the driver 102 and the cam 104 are secured to the main body 110. The cam 104 can then rotate in and out of the slot formed between the upper flange 122 and the lower flange 120 from an extended position, as shown in FIG. 32, to a closed position, as shown in FIG. 31. FIG. 31 illustrates a nub 130 that is attached to the lower flange portion 120 of the main body 110. Of course, any type of nub including press fit nubs, glue in nubs, cast nubs, or any other desired type of nubs can be used. The main body 110 has main body teeth 116 around a predetermined area of the outer surface of the main body 110. Similarly, cam 104 has cam teeth 108 around portions of the exterior surface as well as knurled portions. The cam teeth 108 and the main body teeth 110 can comprise any desired type of teeth such as teeth angled at 75 degrees to enhance engagement with the inner surface of the drain flange. A rubber band can be disposed around the cam 104 and main body portion 110 to cover the main body teeth 116 and the cam teeth 108 to prevent marring or scratching of the interior surface of the drain flange during opening. This may be especially desirable when removing antique types of drain flanges that can be reused. A handle 112 is also attached in any desired manner to the upper surface of the upper flange 122. A handle 112 may be aligned with the support 118 (FIG. 30) and the nub 130 adjacent and opposite to the driver opening 124. Handle 112 can be any desired shape including elliptical or oval, as shown, or any other desired shape to assist the user in handling the tool 100. The main body 100 also has a lag bolt opening 126 that extends through both the upper flange 122 and lower flange 120 so that a lag bolt can be inserted into the opening in the lower flange 120 and through the tool 100. The driver 102 is then rotated in a counterclockwise direction so that cam 104 is rotated to the open position to engage the lag bolt in the lag bolt opening 126 to assist in removing the lag bolt, as explained in more detail below.

FIG. 32 is an additional isometric view of the tool 100 illustrated in FIGS. 30 and 31. As shown in FIG. 32, the cam 104 is rotated to a partially open position outside of the main body 110 by counterclockwise rotation of the driver 102. The rotation of the cam 104 and driver 102 relative to the main body 110 may result from the user holding the handle 112 during rotation of driver 102, or as a result of a nub 130 engaging an arm of the drain flange, as disposed below.

Figure 33:
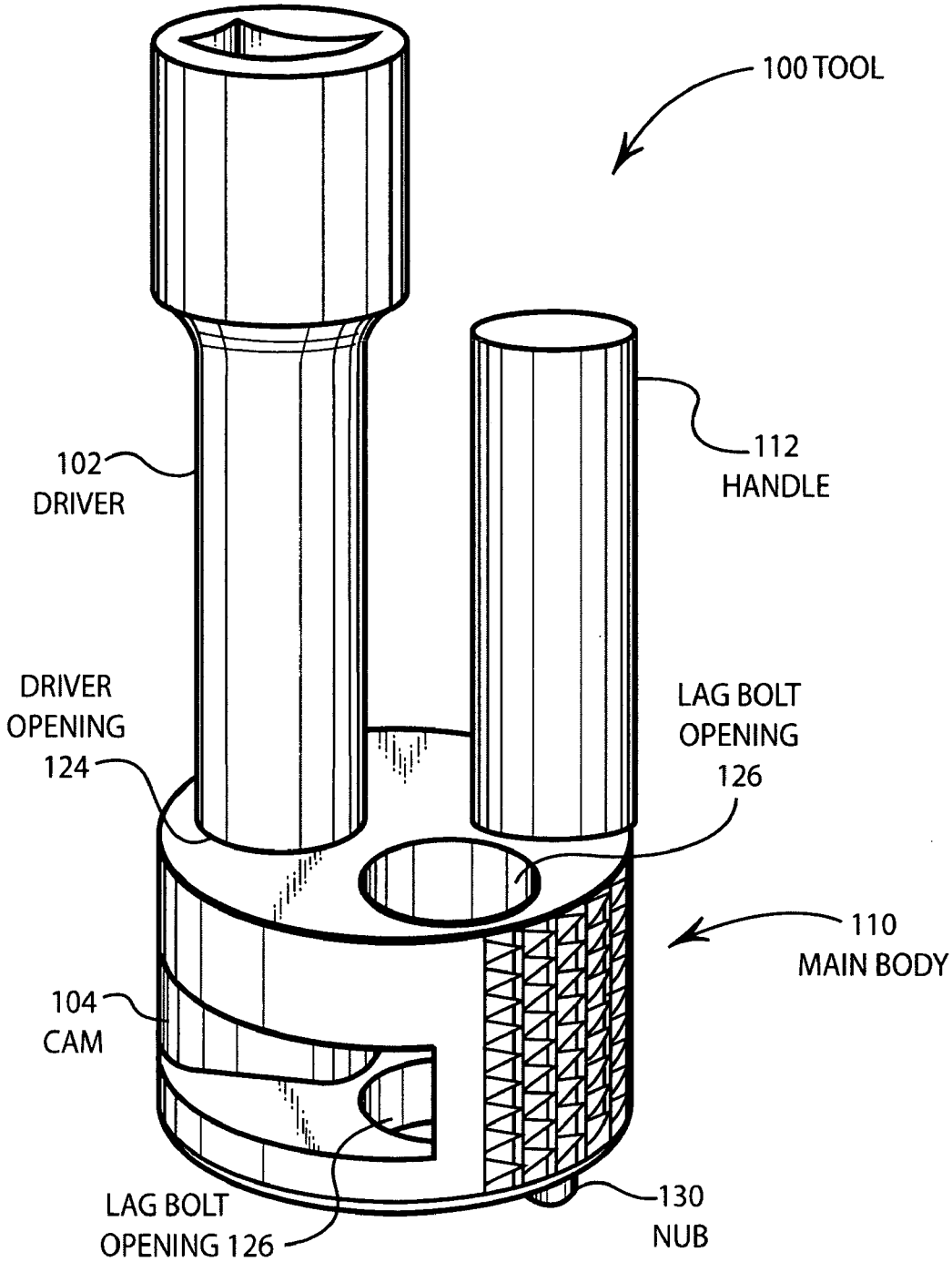
FIG. 33 is an isometric view of the tool of FIG. 30 in a closed position viewed from another angle.

FIG. 33 is another isometric view of the tool 100. As shown in FIG. 33, the driver 102 extends through the driver opening 124 into cam 104 where the driver 102 is secured. Handle 112 and nub 130 are connected to the main body 110. As is clearly seen from FIG. 33, the lag bolt opening 126 extends entirely through the main body 110. The lag bolt opening 126 allows the lag bolt to be inserted from the bottom of the tool 100 through the main body portion 110 so that the cam 104 can engage the lag bolt, or any other desired type of bolt, when the cam is rotated in a counterclockwise direction, as viewed from the top of the tool 100.

Figure 34:
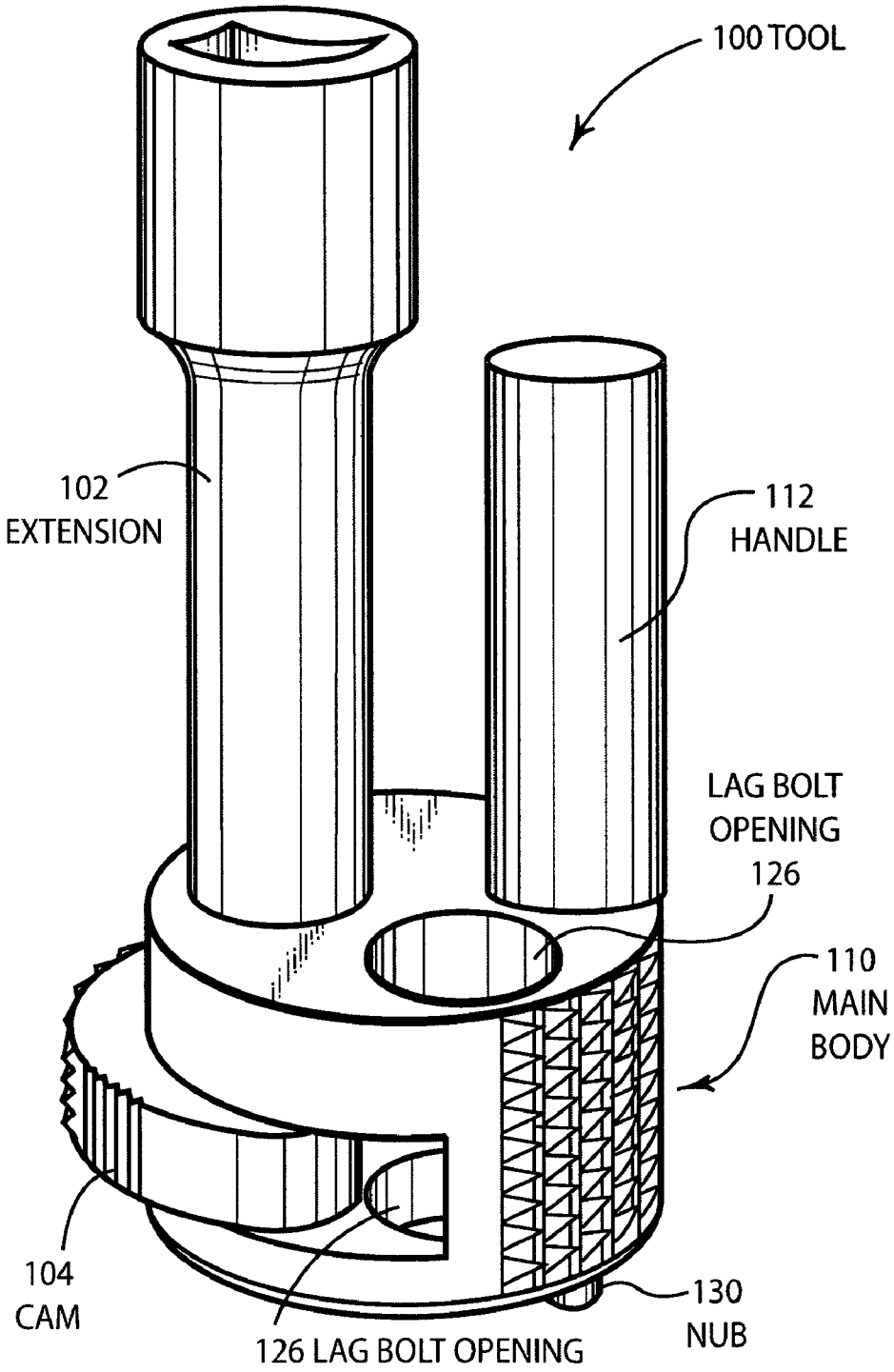
FIG. 34 is an isometric view of the assembled tool of FIG. 30 from the view of FIG. 33 showing the tool in a partially open position.

FIG. 34 is an additional view of the tool 100 that is similar to the view of FIG. 33. FIG. 34, however, shows the cam 104 rotated to a semi-open position in the main body 110. As shown in FIG. 34, as the cam 104 is rotated in a counterclockwise direction, the cam 104 will begin to rotate into the lag bolt opening 126.

Figure 35:
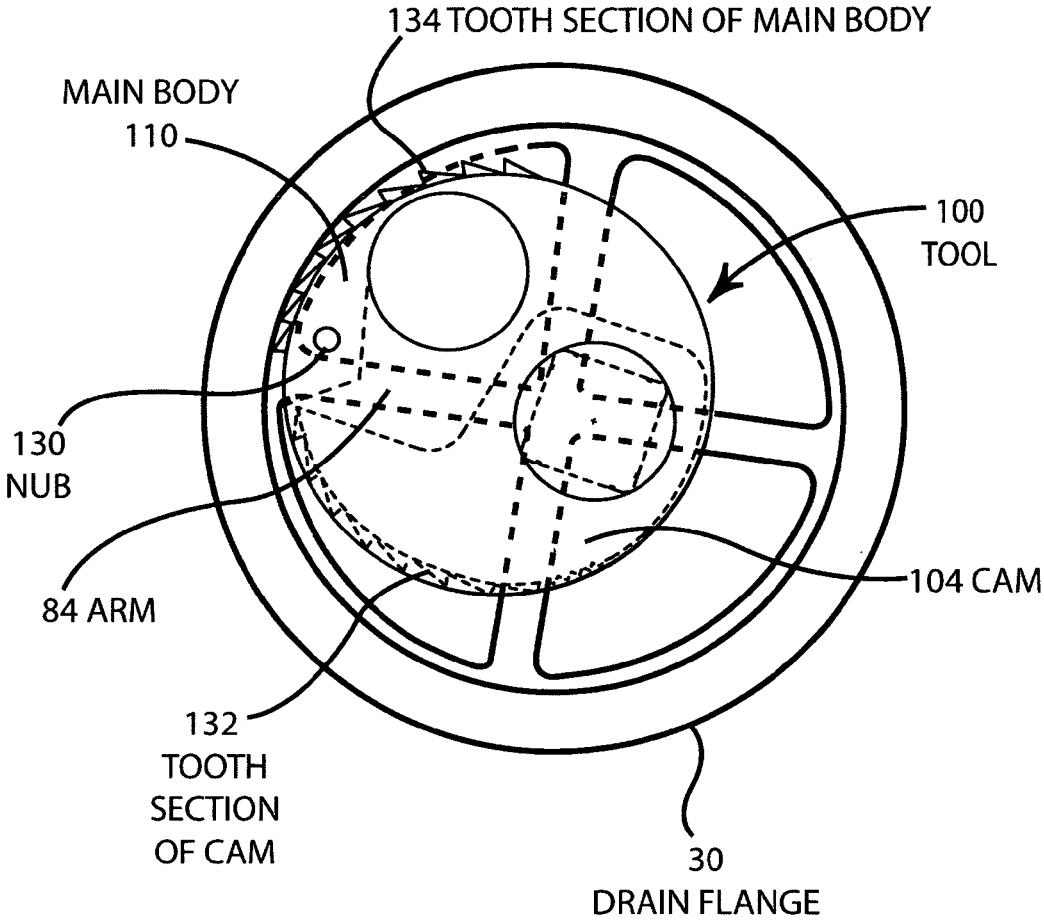
FIG. 35 is a schematic top view of the embodiment of FIG. 30 shown in a drain flange in a closed position.

FIG. 35 is a schematic top view illustrating the tool 100 inserted in a drain flange 30. As shown in FIG. 35, the cam 104 is in a closed position in the main body 110. The main body portion 110 is inserted in the drain flange 30 so that the nub 130 fits between the various arms, such as arm 84, of the drain flange 30. The main body 110 has a tooth section 134 disposed along its exterior surface. As shown, the tooth section 134 has teeth that are angled at 75 degrees to assist in engaging the interior surface of the drain flange 30. Similarly, cam 104 has a tooth section 132 with teeth that are angled at a 75 degree angle to assist in engaging the interior surface of the drain flange 30 when the cam 104 is rotated to an open position.

Figure 36:
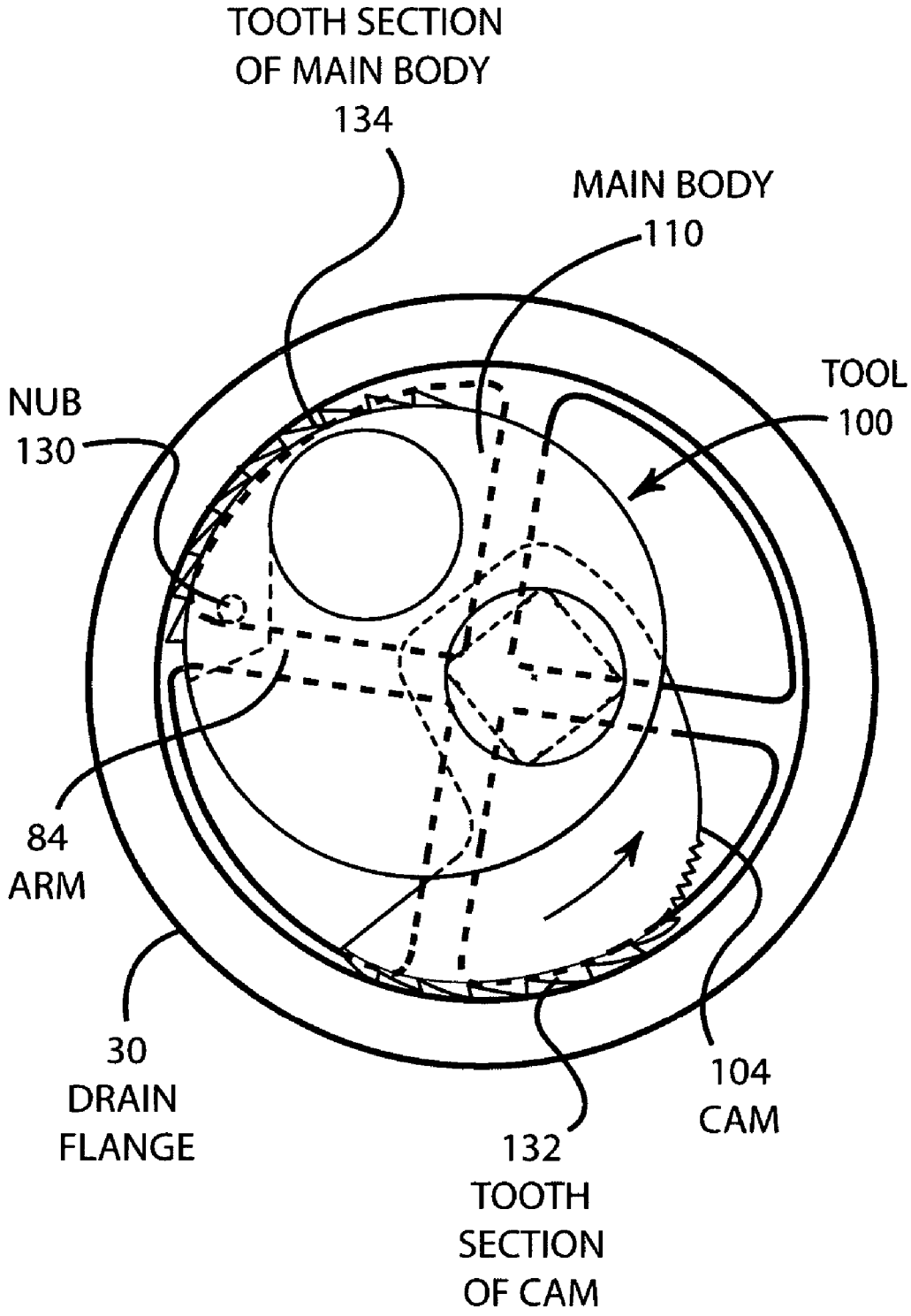
FIG. 36 is a schematic top view of the embodiment of FIG. 30 shown in a drain flange in an open position.

FIG. 36 is an illustration of the tool 100 shown in a drain flange 30 with the cam 104 in an extended position. As shown in FIG. 36, the cam 104 is rotated in a counterclockwise direction, as viewed from the top, so that the main body 110 rotates in a counterclockwise direction until the nub 130 engages arm 34 of the drain flange 30. In other words, the main body 110 pivots around the nub 130 to cause the cam 104 to extend to an open position. In the open position, the tooth section 134 for the main body 110 as well as the tooth section 132 of cam 104 engages the inner surface of the drain flange 130. The counterclockwise torque exerted on the cam 104 is transferred to the drain flange through the tooth section 134 of the main body 110 and through the tooth section 132 of the cam 104, as well as through the nub 130 on arm 84 of the drain flange 130. Hence, the counterclockwise torque is distributed between the main body portion 110, the cam 104 and the nub 130. This distribution of force prevents the cam 104 from causing the drain flange 130 to oval and break and possibly break the drain shoe. In addition, all of the torque is not transferred to the nub 130 which may cause the arm 84 to break during extraction of the drain flange 30. In that regard, if the arm 84 begins to weaken, additional torque is automatically and instantaneously transferred to tooth section 134 and tooth section 132 to prevent the arm 84 from breaking. This automatic and instantaneous distribution of forces provides an optimal transfer of torque from the tool 100 to the drain flange 30. The distribution of torque and the associated forces are allocated dynamically and automatically by the tool 100 to produce a maximum, optimal effect in removing the drain flange 30. The lever arm created by the nub and the rotational point of the cam 104 assists in the transfer of torque from the driver 102 to the nub 130. Of course, that distance can be varied to increase or decrease the ability to transfer torque to the nub 130.

Figure 37:
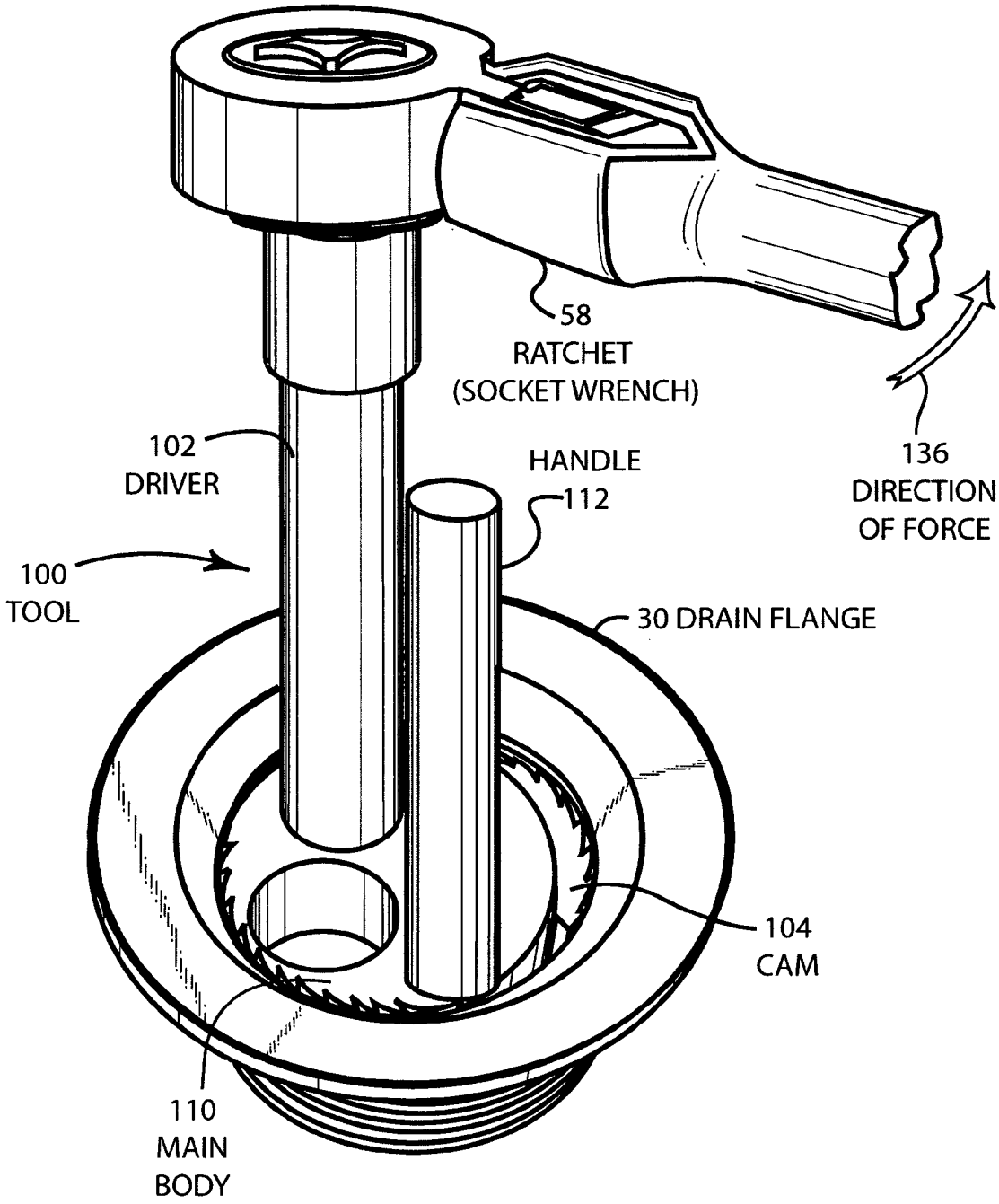
FIG. 37 is an isometric view of the embodiment of FIG. 30 showing the tool inserted in a drain flange.

FIG. 37 is a perspective view of the tool 100 attached to a socket wrench such as a ratchet 58, and disposed in a drain flange 30. The socket wrench can also comprise of breaker bar or other type of tool that is capable of driving the driver 102 either in a clockwise or counterclockwise direction.

Power tools such as drills or other power devices can also be used with this embodiment, or any of the embodiments disclosed herein. As shown in FIG. 37, the cam 104 is extended so that the cam teeth engage the inner surface of the drain flange 30. Similarly, the teeth of the main body portion 110 rest against the inner surface of the drain flange 30 to engage the drain flange 30. In addition, the nub 130 engages an arm (not shown) of the drain flange 30 to transfer torque to the drain flange 30. Force applied in the direction 136 creates the torque that is transferred to the tool 100 through the driver 102. Any desired kind of driver can be used. Handle 112 assists the user in inserting and removing the tool 100 from the drain flange 130 and also allows the user to properly insert the tool so that the nub 130 is inserted between the arms in the drain flange 30.

Figure 38:
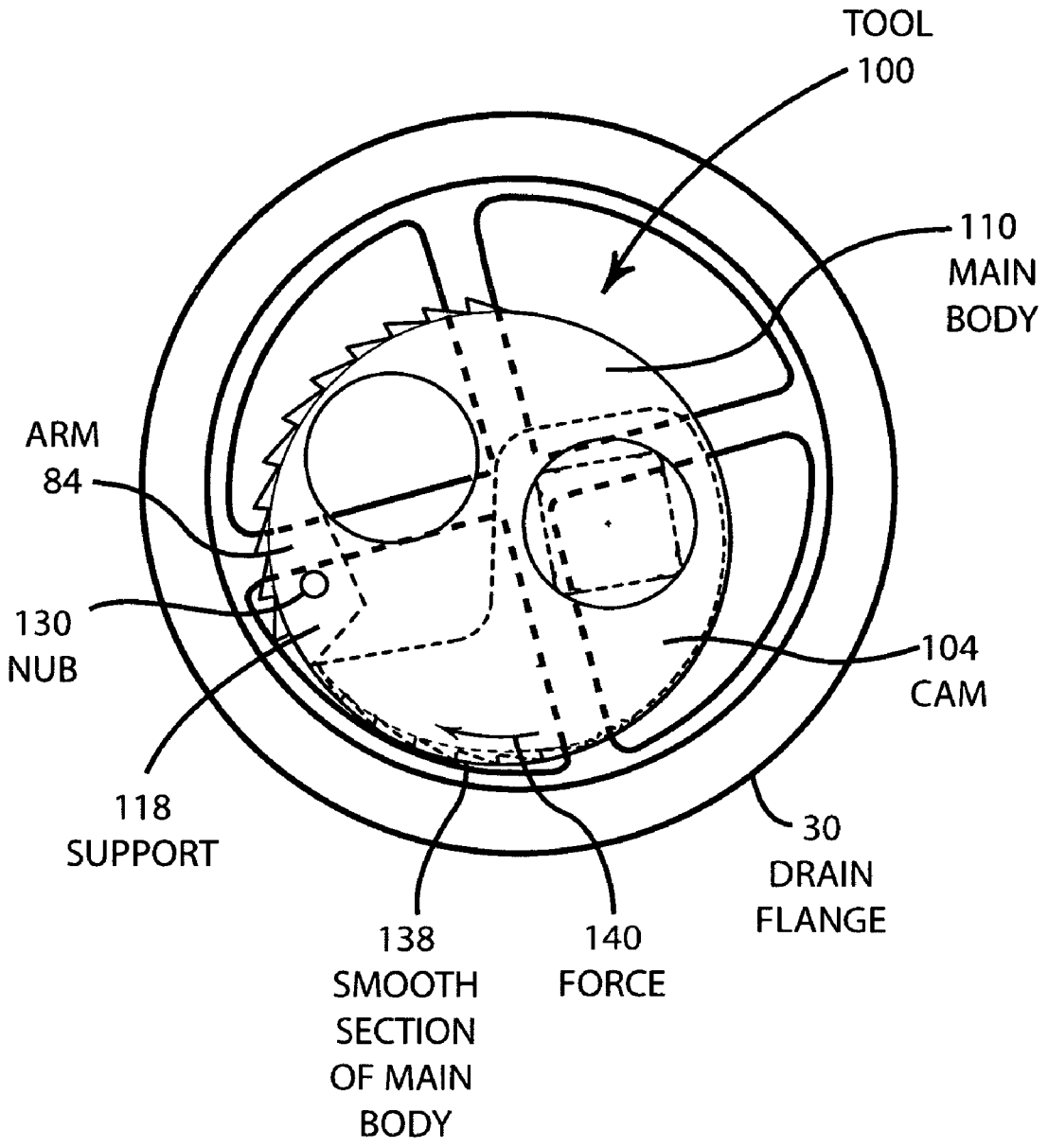
FIG. 38 is a schematic top view of the embodiment of FIG. 30 illustrating the tool disposed in a drain flange in a closed position that is being used to tighten a drain flange.

FIG. 38 is a schematic top view of the tool 100 inserted in the drain flange 30. As shown in FIG. 38, the cam 104 is in a closed position as a result of the force 140 applied in the clockwise direction, as viewed from the top. The end of the cam 104 rests on the support 118 so that the teeth of the cam 104 are recessed in from a smooth section of 138 of the main body portion 110. The force 140 in the clockwise direction causes the nub 130 to rest against arm 84 and transfer torque to arm 184 of the drain flange 30. At the same time, the main body portion 110 pivots on the smooth section 138 which rests against the inner surface of the drain flange 30. In this fashion, torque is transferred in a clockwise direction to the drain flange to allow the user to insert and tighten the drain flange in position in a drain shoe (not shown).

Figure 39:
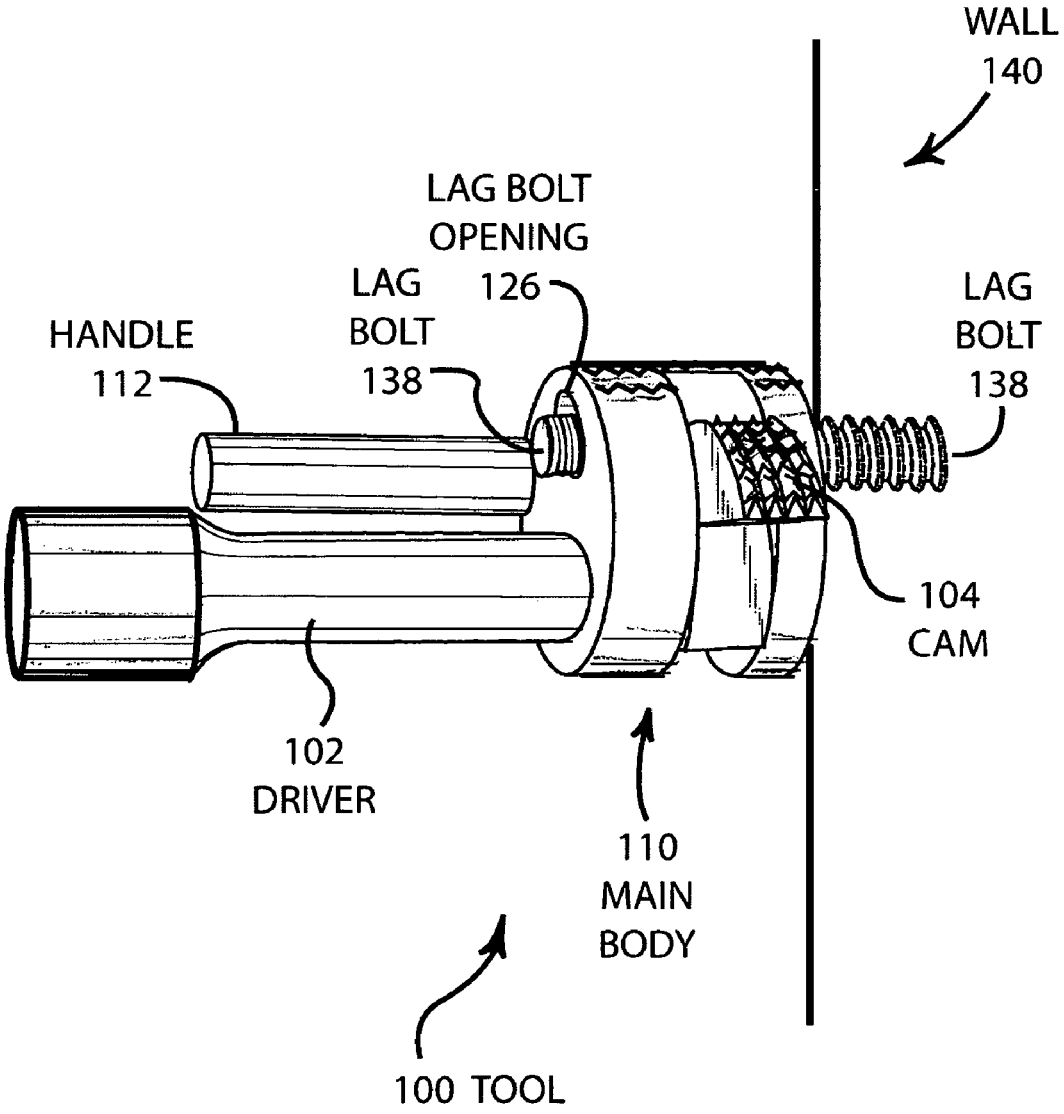
FIG. 39 is an isometric view of the tool of FIG. 30 being used to remove a lag bolt.

FIG. 39 is an isometric view of the tool 100 being used to engage and remove a lag bolt 138 in a wall 140. Lag bolts, such as lag bolt 138 or other types of bolts, can be used to secure various fixtures to walls and floors. For example, lag bolts or other types of bolts, may be used to secure urinals to walls, toilets to floors, sinks to walls, and other purposes. Hence, plumbers frequently have a need to remove bolts when removing drain flanges. As shown in FIG. 39, the tool 100 is positioned so that the lag bolt 138 is inserted through the lag bolt opening 126. The user may use handle 112 to insert the tool over the lag bolt 138. The driver 102 is then rotated in a counterclockwise direction so that the cam 104 rotates in a counterclockwise direction and engages the lag bolt 138 in the lag bolt opening 126. Pressure is applied to the lag bolt 138 between the edges of the lag bolt opening 126 and the cam 104 to firmly grasp the lag bolt 138. Driver 102 may then be further rotated to cause the lag bolt 138 to rotate in a counterclockwise direction causing the lag bolt 138 to be removed from the wall 140 or other surface such as a floor.

Figure 40:
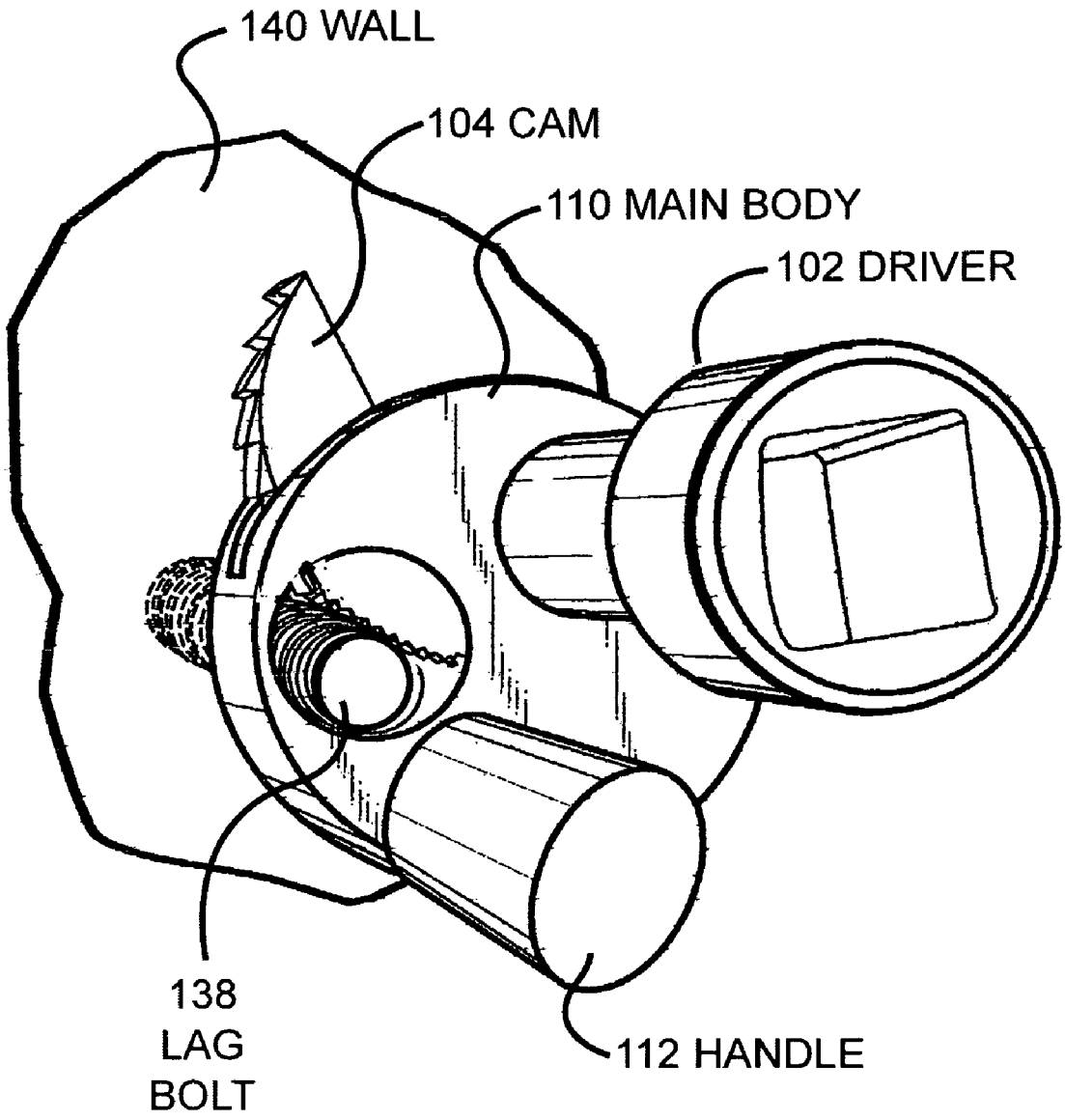
FIG. 40 is another isometric view of the embodiment of FIG. 30 being used to remove a lag bolt.

FIG. 40 is an end perspective view showing the use of the tool 100 to remove lag bolt 138. As shown in FIG. 40, the cam 104 is rotated so that a knurled portion of the cam 104 engages the lag bolt 138. Handle 112 is used to place the main body 110 over the lag bolt 138. Driver 102 is then rotated in a counterclockwise direction so that the lag bolt 138 is securely engaged by the cam 104. Driver 102 continues to rotate in a counterclockwise direction so that the lag bolt 138 is removed from wall 140.

Although various embodiments show different types of teeth and knurled surfaces to create friction between the drain flange inner surface, the main body and the cam or the cam and a lag bolt, any desired type of frictional surface can be used including knurled surfaces, ridged surfaces, teeth, rubber or plastic coated surfaces, etc., with any of the embodiments disclosed herein. In addition, a frictional surface can be formed on the inner surface of the lag bolt opening 126 to add further friction to remove the lag bolt 138.

Figure 41:
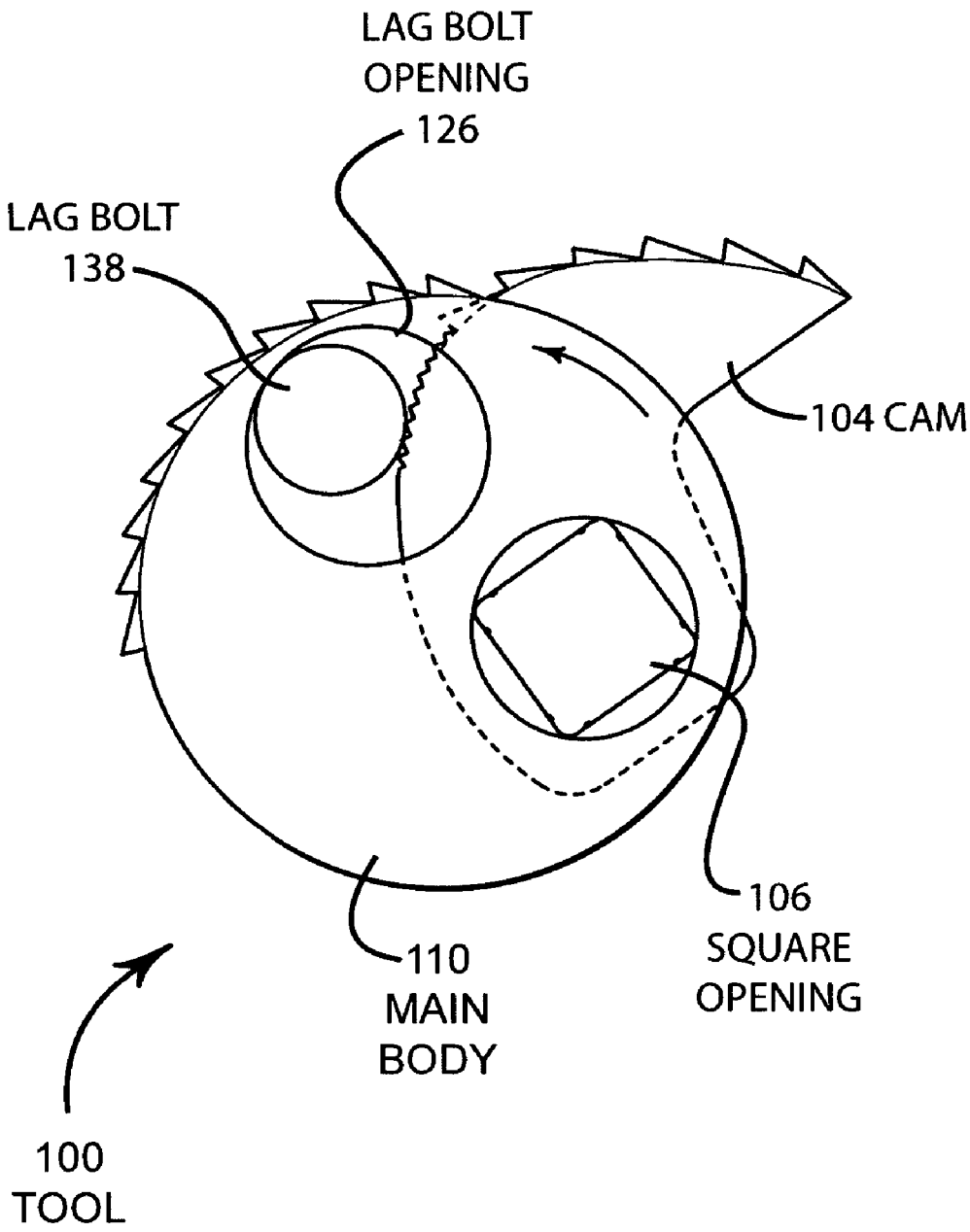
FIG. 41 is a schematic top view of the tool of FIG. 30 being used to remove a lag bolt.

FIG. 41 is a schematic top view illustrating the manner in which the cam 104 engages the bolt 138. As described above, the main body 110 is inserted over the lag bolt so that the lag bolt is inserted through lag bolt opening 126. Cam 104 is rotated in a counterclockwise direction so that the surface of the cam 104 engages the surface of the lag bolt 138. Lag bolt 138 is forced against the surface of the lag bolt opening 126 by the cam 104 so that the cam 104 securely engages the lag bolt 138. Further rotation of the tool 100 causes the tool to rotate around the center point of the lag bolt 138 in a counterclockwise direction causing the lag bolt 138 to be rotated in a counterclockwise direction and removed from a wall, floor or other surface.

The present invention therefore provides a unique tool that is capable of both inserting and removing drain flanges (bathtub shoes) or other similar devices including nipples and other rotationally connected fixtures such as threaded drain flanges. The tool can use separate cams to engage different size drain flanges with optimal ratios of forces created between the radial force and the torque that is sufficient to remove the drain flange. Various ways can be used to adjust the lever arm of the cam to allow an optimal ratio of forces to be used and eliminate the need for additional cams. In addition, a holder can be used that allows the user to control the tool during engagement of the tool within the drain flange. Further, nubs can be included on the bottom of the main body portion to engage arms in the drain flange to increase resistance for both insertion and removal of the drain flange. The holder can be used to adjust the position of the tool in an easy fashion to allow engagement of the nubs with the drain arms at the point at which the cam engages the inner surface of the drain flange. A high degree of torque can be generated that is sufficient to allow the removal of stubborn drain flanges which frequently required the user to cut out the drain flange or replace the appliance such as a tub or sink, etc. In this fashion, the present invention provides a unique tool that solves a persistent problem that has plagued plumbers and provides an easy-to-use and effective tool for both inserting and removing drain flanges. In addition, nubs can be used on the lower portion of the main body of the tool to assist in transfer of torque to the drain flange by engaging the arms or spokes of the drain flange. The nubs can assist in either removing or inserting drain flanges. Smooth portions of the main body and cam can be used to engage the flange inner surface to prevent damage or marring of the inner surface during insertion. Drain flanges can be inserted in this manner with the assistance of a nub. When tightening the drain flange, the cam is recessed into the main body portion so that the teeth in the cam do not scar the internal surface of the drain flange. In addition, the teeth are strategically placed on the outer surface of the main body portion so that the teeth on the main body portion do not engage the internal surface of the flange during tightening, but only during opening of the drain flange. In that regard, the nub is placed in a position to optimize the leverage which assists in applying torque from the driver to the main body portion of the tool.

The unique design of the tool allows forces to be dynamically, instantaneously and automatically distributed between the nub, the main body portion and the cam which assists the tool in being unscrewed from a drain shoe. The dynamic allocation of forces is virtually instantaneous so that the drain flange can be removed without ovaling or without too much force being applied to an arm of the drain flange to cause the arm of the drain flange to break. In this fashion, the drain tool has significant advantages over prior art drain tools by dynamically and automatically applying torque, as needed to remove a drain flange from a drain shoe.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated.

What is claimed is:

1. A tool for inserting and removing drain flanges comprising:

a driver having a socket opening adapted to receive a socket wrench and a shaft having an upper rounded shaft portion having a first predetermined diameter, a square shaft portion that has a diagonal corner to corner measurement that does not exceed said first predetermined diameter, and a lower rounded shaft portion that has a second predetermined diameter that is less than said first predetermined diameter;

a main body having an upper main body flange and a lower main body flange that are coupled via a main body support to form a slot between said upper main body flange and said lower main body flange, said upper main body flange having an upper rounded opening that is sufficiently large to allow insertion and rotation of said upper rounded shaft portion, said lower main body flange having a lower rounded opening that is sufficiently large to allow insertion and rotation of said lower rounded shaft portion, said main body having teeth disposed at least along predetermined portions of an outer surface of said main body; and, a cam having a thickness that allows said cam to be inserted and rotated in said slot, said cam having at least one square opening that is offset from a center point of said cam and that is adapted to engage said square shaft portion so that said cam rotates between a closed position and an extended position relative to said main body, said cam having teeth to engage said drain flange.

2. The tool of claim 1 wherein said cam has an opening that allows said cam to rotate 360° in said main body.

3. The tool of claim 1 wherein said lower rounded shaft portion further includes a detent ball that engages a slot in said lower rounded opening of said lower main body flange.

4. The tool of claim 1 wherein said square shaft portion of said driver is adapted to be force fit into said square opening in said cam.

5. The tool of claim 1 further comprising an additional cam that is a different size from said cam to allow said tool to be used with various size drain flanges.

6. The tool of claim 1 wherein said cam has two square openings that are offset by different amounts from said center of said cam.

7. The tool of claim 1 wherein said cam further includes an adjustable plate that can be used to vary the distance of said square opening from said center point of said cam.

8. The tool of claim 1 further comprising:

a nub attached to said lower main body flange that is adapted to engage an arm of said drain flange and exert a clockwise force on said arm whenever said driver creates a clockwise torque so that said cam is forced against said main body support and said main body rotates in a clockwise direction in said drain flange around said nub until a smooth section of said main body rests against an inner surface of said drain flange.

9. The tool of claim 1 further comprising:

a nub that exerts a force on said arm in a counterclockwise direction whenever said driver creates a counterclockwise torque so that said main body rotates in a counterclockwise direction in said drain flange around said nub until said teeth on said main body engage an inner surface of said drain flange and said cam is rotated to said extended position so that said teeth on said cam engage said inner surface of said drain flange.

10. A tool for inserting and removing a drain flange comprising:

a driver having a round shaft portion that has a predetermined diameter and a square shaft portion at a first end of said driver that has a diagonal, corner to corner measurement that does not exceed said predetermined diameter, and a square receptacle at a second end of said driver that is adapted to receive a socket wrench;

a main body having an upper main body flange and a lower main body flange that are coupled via a main body support to form a slot between said upper main body flange and said lower main body flange, said upper main body flange having a round opening in which said round shaft portion of said driver fits and rotates, said main body having teeth disposed along predetermined portions of an outer surface of said main body;

a cam having a thickness that allows said cam to be inserted and rotated in said slot, said cam having a square opening that is offset from a center point of said cam, said square opening being adapted to engage said square shaft portion of said driver so that said round shaft portion of said driver rotates in said round opening of said upper main body flange and rotates said cam between a closed position and an extended position relative to said main body, said cam having teeth to engage said drain flange in said extended position.

11. The tool of claim 10 further comprising:

a nub attached to said lower main body flange that is adapted to engage an arm of said drain flange and exert a clockwise force on said arm whenever said driver creates a clockwise torque so that said cam is forced against said main body support and said main body rotates in a clockwise direction in said drain flange around said nub until a smooth section of said main body rests against an inner surface of said drain flange.

12. The tool of claim 11 wherein said nub further comprises:

a nub that exerts a force on said arm in a counterclockwise direction whenever said driver creates a counterclockwise torque so that said main body rotates in a counterclockwise direction in said drain flange around said nub until said teeth on said main body engage an inner surface of said drain flange and said cam is rotated to said extended position so that said teeth on said cam engage said inner surface of said drain flange.

13. The tool of claim 10 further comprising an opening formed in said upper main body flange and said lower main body flange that is adapted to receive a bolt that is engaged by said teeth on said cam whenever said cam is rotated in a counterclockwise direction, so that said bolt can be rotated in a counterclockwise direction.

14. The tool of claim 11 further comprising an opening formed in said upper main body flange and said lower main body flange that is adapted to receive a bolt that is engaged by said teeth on said cam whenever said cam is rotated in a counterclockwise direction, so that said bolt can be rotated in a counterclockwise direction.

15. The tool of claim 12 further comprising an opening formed in said upper main body flange and said lower main body flange that is adapted to receive a bolt that is engaged by said teeth on said cam whenever said cam is rotated in a counterclockwise direction, so that said bolt can be rotated in a counterclockwise direction.

16. The tool of claim 10 wherein said square shaft is adapted to be force fit into said square opening of said cam.

17. The tool of claim 11 further comprising a detent ball on said square shaft portion that engages a slot in said square opening of said cam.

18. A tool for inserting and removing a drain flange comprising:

first means for driving a cam in both a counterclockwise and clockwise direction, said first means having a round shaft portion that has a predetermined diameter and a square shaft portion at a first end of said driver that has a diagonal, corner to corner measurement that does not exceed said predetermined diameter, and a square receptacle at a second end of said driver that is adapted to receive a socket wrench;

second means for transferring a torque from said first means to said drain flange, said second means having an upper main body flange and a lower main body flange that are coupled via a main body support to form a slot between said upper main body flange and said lower main body flange, said upper main body flange having a round opening in which said round shaft portion of said driver fits and rotates, said main body having teeth disposed along predetermined portions of an outer surface of said main body;

third means for transferring said torque from said first means to said drain flange, said third means having a thickness that allows said cam to be inserted and rotated in said slot, said cam having a square opening that is offset from a center point of said cam, said square opening being adapted to engage said square shaft portion of said driver so that said round shaft portion of said driver rotates in said round opening of said upper main body flange and rotates said cam between a closed position and an extended position relative to said main body, said cam having teeth to engage said drain flange in said extended position;

fourth means for engaging an arm of drain flange and transferring said torque from said first means to said drain flange through said arm, said fourth means attached to said lower main body flange that is adapted to engage an arm of said drain flange and exert a clockwise force on said arm whenever said driver creates a clockwise torque so that said cam is forced against said main body support and said main body rotates in a clockwise direction in said drain flange around said nub until a smooth section of said main body portion rests against an inner surface of said drain flange, and exerts a force on said arm in counterclockwise direction whenever said driver creates a counterclockwise torque so that said main body portion rotates in a counterclockwise direction in said drain flange around said nub until said teeth on said main body portion engage an inner surface of said drain flange and said cam is rotated to said extended position so that said teeth on said cam engage said inner surface of said drain flange.

19. A tool for inserting and removing drain flanges comprising:

a driver having an upper rounded portion and a lower rounded portion;

a main body having an upper main body flange and a lower main body flange that are coupled via a main body support to form a slot between said upper main body flange and said lower main body flange, said upper main body flange having an upper rounded opening that is sufficiently large to allow insertion and rotation of said upper rounded portion, said lower main body flange having a lower rounded opening that is sufficiently large to allow insertion and rotation of said lower rounded portion, said main body having a functional surface disposed at least along predetermined portions of an outer surface of said main body; and, a cam having a thickness that allows said cam to be inserted and rotated in said slot, said cam attached to said driver in a position that is offset from a center point of said cam so that said cam rotates between a closed position and an extended position relative to said main body, said cam having a frictional surface that engages said drain flange.

20. The tool of claim 19 further comprising an additional cam that is a different size from said cam to allow said tool to be used with various size drain flanges.

21. The tool of claim 19 further comprising:

a nub attached to said lower main body flange that is adapted to engage an arm of said drain flange and exert a clockwise force on said arm whenever said driver creates a clockwise torque so that said cam is forced against said main body support and said main body rotates in a clockwise direction in said drain flange around said nub until a smooth section of said main body rests against an inner surface of said drain flange, and exerts a force on said arm in a counterclockwise direction whenever said driver creates a counterclockwise torque so that said main body rotates in a counterclockwise direction in said drain flange around said nub until said frictional surface on said main body engages an inner surface of said drain flange and said cam is rotated to said extended position so that said frictional surface on said cam engage said inner surface of said drain flange.

22. A tool for inserting and removing a drain flange comprising:

a driver having a round portion that is adapted to receive torque;

a main body having an upper main body flange and a lower main body flange that are coupled via a main body support to form a slot between said upper main body flange and said lower main body flange, said upper main body flange having an opening in which said round portion of said driver fits and rotates, said main body having a frictional surface disposed along predetermined portions of an outer surface of said main body;

a cam having a thickness that allows said cam to be inserted and rotated in said slot, said cam attached to said driver in a position that is offset from a center point of said cam so that said round portion of said driver rotates in said round opening of said upper main body flange and rotates said cam between a closed position and an extended position relative to said main body, said cam having a frictional surface to engage said drain flange in said extended position.

23. The tool of claim 22 further comprising:

a nub attached to said lower main body flange that is adapted to engage an arm of said drain flange and exert a clockwise force on said arm whenever said driver creates a clockwise torque so that said cam is forced against said main body support and said main body rotates in a clockwise direction in said drain flange around said nub until a smooth section of said main body rests against an inner surface of said drain flange, and exerts a force on said arm in counterclockwise direction whenever said driver creates a counterclockwise torque so that said main body rotates in a counterclockwise direction in said drain flange around said nub until said frictional surface on said main body engages an inner surface of said drain flange and said cam is rotated to said extended position so that said frictional surface on said cam engages said inner surface of said drain flange.

24. The tool of claim 22 further comprising an opening formed in said upper main body flange and said lower main body flange that is adapted to receive a bolt that is engaged by said frictional surface on said cam whenever said cam is rotated in a counterclockwise direction, so that said bolt can be rotated in a counterclockwise direction.

* * * * *